US009938691B2

(12) United States Patent
Hiraku

(10) Patent No.: US 9,938,691 B2
(45) Date of Patent: Apr. 10, 2018

(54) HYDRAULIC SYSTEM FOR WORK MACHINE

(71) Applicant: Hitachi Construction Machinery Co., Ltd., Bunkyo-ku, Tokyo (JP)

(72) Inventor: Kenji Hiraku, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 385 days.

(21) Appl. No.: 14/646,428

(22) PCT Filed: Nov. 18, 2013

(86) PCT No.: PCT/JP2013/081022
§ 371 (c)(1),
(2) Date: May 21, 2015

(87) PCT Pub. No.: WO2014/109131
PCT Pub. Date: Jul. 17, 2014

(65) Prior Publication Data

US 2015/0292183 A1 Oct. 15, 2015

(30) Foreign Application Priority Data

Jan. 8, 2013 (JP) ..... 2013-001344

(51) Int. Cl.
*F15B 21/14* (2006.01)
*E02F 9/22* (2006.01)
(Continued)

(52) U.S. Cl.
CPC ..... *E02F 9/2217* (2013.01); *E02F 9/2282* (2013.01); *E02F 9/2289* (2013.01);
(Continued)

(58) Field of Classification Search
CPC ..... F15B 11/17; F15B 2211/20576
(Continued)

(56) References Cited

U.S. PATENT DOCUMENTS 3,952,509 A * 4/1976 Coleman ..... E02F 9/2232 180/403
4,033,127 A * 7/1977 Amstutz ..... E02F 9/2239 60/455

(Continued)

FOREIGN PATENT DOCUMENTS

JP 62-33947 A 2/1987
JP 11-141504 A 5/1999

(Continued)

OTHER PUBLICATIONS

International Search Report (PCT/ISA/210) dated Jan. 28, 2014, with English translation (four (4) pages).

(Continued)

*Primary Examiner* — Michael Leslie
*Assistant Examiner* — Matthew Wiblin
(74) *Attorney, Agent, or Firm* — Crowell & Moring LLP

(57) ABSTRACT

Delivery ports of a closed circuit hydraulic pump are connected to a head-side chamber and a rod-side chamber of an arm/boom cylinder. A switching valve is arranged between the head-side chamber and a delivery port of an open circuit hydraulic pump. A proportional control valve is arranged between the head-side chamber and a hydraulic fluid tank. At times of cylinder extension, both of the closed and open circuit hydraulic pumps and the switching valve are controlled so that the delivery flows from the closed and open circuit hydraulic pumps are sent to the head-side chamber. At times of cylinder retraction, the closed circuit hydraulic pump and the proportional control valve are controlled so that part of an outward flow from the head-side chamber is returned to the closed circuit hydraulic pump and other part of the outward flow is returned to the hydraulic fluid tank.

5 Claims, 7 Drawing Sheets

(51) Int. Cl.
*F15B 11/17* (2006.01)
*F15B 7/06* (2006.01)

(52) U.S. Cl.
CPC ..... *E02F 9/2292* (2013.01); *E02F 9/2296* (2013.01); *F15B 7/06* (2013.01); *F15B 11/17* (2013.01); *F15B 21/14* (2013.01); *F15B 2211/20546* (2013.01); *F15B 2211/20561* (2013.01); *F15B 2211/20576* (2013.01); *F15B 2211/27* (2013.01); *F15B 2211/30595* (2013.01); *F15B 2211/7053* (2013.01); *F15B 2211/7142* (2013.01); *F15B 2211/785* (2013.01)

(58) Field of Classification Search
USPC ..... 60/422, 426, 428
See application file for complete search history.

(56) References Cited

U.S. PATENT DOCUMENTS 4,369,625 A * 1/1983 Izumi ..... E02F 9/2242 414/699
5,069,037 A * 12/1991 Sakigawa ..... B60K 25/02 60/426
5,946,910 A * 9/1999 Hayashi ..... E02F 9/2225 60/421
7,191,593 B1 * 3/2007 Ho ..... B64C 13/50 244/78.1
7,231,765 B2 * 6/2007 Kawamura ..... F04B 1/22 60/487
7,543,449 B2 * 6/2009 Ivantysynova ..... F15B 7/006 60/464
8,720,196 B2 * 5/2014 Kawasaki ..... E02F 9/2075 60/422
2005/0246082 A1 * 11/2005 Miki ..... E02F 9/2075 701/50
2013/0000292 A1 * 1/2013 Edler ..... F15B 11/055 60/327
2014/0020370 A1 * 1/2014 Berg ..... E02F 9/2242 60/327
2014/0165549 A1 * 6/2014 Gabibulayev ..... F15B 21/001 60/421

FOREIGN PATENT DOCUMENTS

JP 2002-54602 A 2/2002
JP 2004-190845 A 7/2004
JP 2005-76781 A 3/2005

OTHER PUBLICATIONS

Japanese-language Written Opinion (PCT/ISA/237) dated Jan. 28, 2014 (three (3) pages).
International Preliminary Report on Patentability (PCT/IB/338 & PCT/IB/373) issued in PCT Application No. PCT/JP2013/081022 dated Jul. 23, 2015, including English translation of Document C2 (Japanese-language Written Opinion (PCT/ISA/237)) previously filed on May 21, 2015 (seven (7) pages).

* cited by examiner

FIG. 3

| OPERATION OF HYDRAULIC EXCAVATOR | | | OPERATION OF HYDRAULIC PUMP | | | | OPERATION OF SWITCHING VALVE | | | |
|---|---|---|---|---|---|---|---|---|---|---|
| | | | OPEN CIRCUIT HYDRAULIC PUMP | | CLOSED CIRCUIT HYDRAULIC PUMP | | SWITCHING VALVE (NORMALLY CLOSED) | | PROPORTIONAL CONTROL VALVE (NORMALLY OPEN) | |
| | | | 1a | 1b | 2a | 2b | 12a | 12b | 14a | 14b |
| SINGLE OPERATION | 1 | BOOM RAISING | OFF | ON | OFF | ON | OFF | ON | OFF | ON |
| | 2 | BOOM LOWERING (LOW SPEED) | OFF | OFF | OFF | ON | OFF | OFF | OFF | OFF |
| | 3 | BOOM LOWERING (HIGH SPEED) | OFF | OFF | OFF | ON | OFF | ON | OFF | ON |
| | 4 | BOOM LOWERING (EXCAVATION) | OFF | OFF | OFF | ON | OFF | OFF | OFF | OFF |
| | 5 | ARM CROWDING | ON | OFF | ON | OFF | ON | OFF | ON | OFF |
| | 6 | ARM DUMPING | OFF | OFF | ON | OFF | ON | OFF | ON | OFF |
| | 7 | SWINGING | ON | OFF | OFF | OFF | OFF | OFF | OFF | OFF |
| COMBINED OPERATION | a | SWINGING & BOOM RAISING | ON | ON | OFF | ON | OFF | ON | OFF | ON |
| | b | TRAVELING & ARM CROWDING | ON | ON | ON | OFF | ON | OFF | ON | OFF |
| | c | BOOM RAISING & ARM CROWDING | ON | ON | ON | ON | ON | ON | ON | ON |
| | d | BUCKET & ARM | ON | ON | ON | OFF | ON | OFF | ON | OFF |
| | e | SWINGING & ARM | OFF | ON | ON | OFF | OFF | OFF | OFF | OFF |
| | f | BOOM & ARM & TRAVELING, ETC. | ON | ON | ON | ON | OFF | OFF | OFF | OFF |

HYDRAULIC SYSTEM FOR WORK MACHINE

TECHNICAL FIELD

The present invention relates to a hydraulic system for a work machine, and in particular, to a hydraulic system for a work machine employing a hydraulic closed circuit in which a hydraulic actuator is directly driven by a hydraulic pump.

BACKGROUND ART

In recent years energy saving is an important development issue in construction machines such as hydraulic excavators and wheel loaders. To achieve the energy saving of the construction machine, energy saving of the hydraulic system itself is essential. In this regard, examination is being made on employment of a hydraulic closed circuit in which a hydraulic pump having two delivery ports and being capable of bidirectional delivery (hereinafter referred to as a "bidirectional delivery hydraulic pump") is connected to a hydraulic actuator in closed circuit connection to directly drive the hydraulic actuator. In such a hydraulic closed circuit, there is no pressure loss caused by control valves. There is no flow loss either since only a necessary flow is delivered from the hydraulic pump. Further, it is possible to recover potential energy of the actuator and energy at times of deceleration (energy regeneration). As above, the energy saving of the hydraulic system is made possible by employing a hydraulic closed circuit for the hydraulic system.

Hydraulic cylinders of the single rod type (single rod hydraulic cylinders) are generally used as the hydraulic cylinders in construction machines. In order to connect such a single rod hydraulic cylinder to a hydraulic pump in closed circuit connection, it is necessary to absorb a flow rate difference that is caused by a pressure-receiving area difference between the head-side chamber and the rod-side chamber of the hydraulic cylinder. In the conventional technology, a charge pump and a low-pressure selection valve (flushing valve) are generally used to absorb the flow rate difference (see FIG. 2 of Patent Literature 1, for example). There have also been disclosed hydraulic systems absorbing the flow rate difference without using a charge pump or a low-pressure selection valve in FIGS. 1 and 3 of the Patent Literature 1 and in Patent Literatures 2 and 3.

In the hydraulic system disclosed in FIGS. 1 and 3 of the Patent Literature 1, two bidirectional delivery hydraulic pumps are arranged with their drive shafts connected to each other. The two delivery ports of one hydraulic pump are connected to the head-side chamber and the rod-side chamber of a hydraulic cylinder, respectively. One delivery port of the other hydraulic pump is connected to the head-side chamber, and the other delivery port is connected to a hydraulic fluid tank.

In the hydraulic system disclosed in the Patent Literature 2, a hydraulic closed circuit including a hydraulic cylinder and a hydraulic pump connected together in closed circuit connection is connected to an open circuit. At times of extension of the hydraulic cylinder, the head-side chamber of the hydraulic cylinder is supplemented with hydraulic fluid supplied from a hydraulic pump on the open circuit's side. At times of retraction of the hydraulic cylinder, surplus hydraulic fluid is returned from a hydraulic line on the low pressure side of the hydraulic cylinder to the hydraulic fluid tank via a low-pressure selection valve in the same way as in the conventional technology.

In the hydraulic system disclosed in the Patent Literature 3 (FIGS. 2 and 7), a hydraulic closed circuit including a boom cylinder and a hydraulic pump connected together in closed circuit connection is connected to an open circuit. At times of boom raising (at times of extension of the hydraulic cylinder), the hydraulic fluid is supplied from a hydraulic pump on the open circuit's side to the head-side chamber of the boom cylinder (high pressure side), while a hydraulic line on the rod side (low pressure side) of the hydraulic closed circuit is connected to the hydraulic fluid tank via a switching valve and a relief valve. At times of boom lowering (at times of retraction of the hydraulic cylinder), surplus hydraulic fluid is returned to the hydraulic fluid tank via the switching valve and the relief valve.

PRIOR ART LITERATURE

Patent Literature

Patent Literature 1: JP, A 2002-54602
Patent Literature 2: JP, A 2005-76781
Patent Literature 3: JP, A 2004-190845

SUMMARY OF THE INVENTION

Problem to be Solved by the Invention

In conventional and ordinary hydraulic systems like the system shown in FIG. 2 of the Patent Literature 1, the hydraulic closed circuit at times of extension of the hydraulic cylinder is charged with a flow from the charge pump corresponding to the pressure-receiving area difference between the head-side chamber and the rod-side chamber. For example, when a cylinder whose pressure-receiving area ratio between the head-side chamber and the rod-side chamber is 2:1 is used, the hydraulic closed circuit is charged with a flow corresponding to 50% of the flow supplied to the head-side chamber. In a hydraulic excavator, however, this means that a high flow as high as 50% of the maximum flow rate of the main hydraulic pump has to be supplied from the charge pump. Thus, the conventional hydraulic system involves a major problem in term of energy saving performance and mountability.

Further, since the conventional hydraulic system is configured to return surplus hydraulic fluid from a hydraulic line connected to the low pressure side of the hydraulic cylinder to the hydraulic fluid tank via a low-pressure selection valve, the inward flow rate into the rod-side chamber and the outward flow rate from the head-side chamber change depending on the pressure-receiving area ratio between the rod-side chamber and the head-side chamber when the load direction of the hydraulic cylinder inverts (when switching occurs between the low pressure side and the high pressure side of the hydraulic cylinder). As a result, great fluctuation in the speed of the hydraulic cylinder can cause shocks and vibrations and can lead to deterioration in the operability. Especially in construction machines, the load direction inversion occurs frequently in cylinders for driving the work implement. In the case of an arm cylinder for driving the arm of a hydraulic excavator, for example, the rod-side chamber is on the high pressure side (since the arm weight works in the direction of expanding the cylinder) in the state in which the arm has been extended, while the head-side chamber is on the high pressure side (since the arm weight works reversely in the direction of contracting the cylinder) in the state in which the arm has been folded (occurrence of the load direction inversion). Therefore, it is desirable in terms of operability that the cylinder speed not fluctuate greatly at times of load direction inversion.

In the hydraulic system described in FIGS. 1 and 3 of the Patent Literature 1, the flow rate difference caused by the pressure-receiving area difference between the head-side chamber and the rod-side chamber is absorbed by the bidirectional delivery hydraulic pump by sucking in and discharging the surplus flow and the deficit flow between the head-side chamber of the hydraulic cylinder and the hydraulic fluid tank. As a result, the necessary flow rate of the charge pump is reduced and reduction in the displacement (capacity) of the charge pump becomes possible. Further, smooth operation of the cylinder becomes possible since the flushing valve becomes unnecessary. However, the self-priming performance of the bidirectional delivery hydraulic pump is low since the port areas of the two ports of the bidirectional delivery hydraulic pump, which can also work as delivery ports at the same time, are small compared to the suction port of the open circuit pump. Thus, in cases where the hydraulic system is configured to suck in the hydraulic fluid from the hydraulic fluid tank by using such a hydraulic pump having small port areas and low self-priming performance, cavitation occurs in the hydraulic pump especially when the hydraulic cylinder is expanded at a high speed and that can disable smooth operation of the hydraulic cylinder or high speed of the hydraulic cylinder. In order to resolve this problem, a high-capacity charge pump has to be provided separately, and consequently, the miniaturization of the charge pump becomes impossible.

The hydraulic system described in the Patent Literature 2 is configured to return the surplus hydraulic fluid from the hydraulic line connected to the low pressure side of the hydraulic cylinder to the hydraulic fluid tank via the low-pressure selection valve at times of retraction of the hydraulic cylinder. Therefore, the load direction inversion at times of retraction of the hydraulic cylinder can cause shocks and vibrations and can lead to deterioration in the operability in the same way as in the conventional and ordinary hydraulic systems like the system shown in FIG. 2 of the Patent Literature 1.

The hydraulic closed circuit of the hydraulic system described in the Patent Literature 3 (FIGS. 2 and 7) is configured to drive the boom cylinder in which the load direction does not change (the rod-side chamber is constantly on the low pressure side). At times of retraction of the boom cylinder, a flow (part of the delivery flow from the hydraulic pump) corresponding to the surplus over the inward flow rate into the rod-side chamber (low pressure side) is returned to the hydraulic fluid tank via the switching valve and the relief valve. Thus, the delivery pressure of the hydraulic pump is suppressed to a preset pressure of the relief valve at times of retraction of the boom cylinder. However, if a hydraulic closed circuit having such a configuration is employed for an arm cylinder in which the load direction changes, there is a possibility that the driving of the arm cylinder becomes impossible (due to the delivery pressure falling below the pressure necessary for the driving of the arm cylinder) when the rod-side chamber switches into the high pressure side in the load direction inversion at times of retraction of the arm cylinder. Further, if it is attempted to drive the arm cylinder with the switching valve closed in order to achieve a delivery pressure higher than the relief pressure, a problem arises in that the surplus flow (part of the outward flow from the head-side chamber) that cannot be absorbed by the hydraulic pump cannot be returned to the hydraulic fluid tank.

The object of the present invention is to provide a hydraulic system for a work machine that makes it possible to improve the energy saving performance and the mountability by miniaturizing the charge system by reducing the necessary flow rate of the charge pump in the hydraulic closed circuit for driving a single rod hydraulic cylinder with a bidirectional delivery hydraulic pump and to improve the operability by reducing shocks and vibrations by suppressing the occurrence of the cavitation at times of high-speed driving of the cylinder and the fluctuation in the cylinder operation speed at times of load direction inversion.

Means for Solving the Problem (1) To achieve the above object, the present invention provides a hydraulic system for a work machine equipped with at least one closed circuit hydraulic pump having two delivery ports and being capable of bidirectional delivery and at least one single rod hydraulic cylinder having a head-side chamber and a rod-side chamber to which the two delivery ports of the closed circuit hydraulic pump are connected, respectively, comprising: at least one open circuit hydraulic pump having a suction port for sucking in hydraulic fluid from a hydraulic fluid tank and a delivery port for delivering the hydraulic fluid; a first switching valve which is arranged between the head-side chamber of the hydraulic cylinder and the delivery port of the open circuit hydraulic pump; a proportional control valve which is arranged between the head-side chamber of the hydraulic cylinder and the hydraulic fluid tank; and a control unit operable to control the closed circuit hydraulic pump, the open circuit hydraulic pump and the first switching valve at times of extension of the hydraulic cylinder so that a delivery flow is sent to the head-side chamber of the hydraulic cylinder from both the closed circuit hydraulic pump and the open circuit hydraulic pump, and to control the closed circuit hydraulic pump and the proportional control valve at times of retraction of the hydraulic cylinder so that part of an outward flow from the head-side chamber of the hydraulic cylinder is returned to the closed circuit hydraulic pump and other part of the outward flow from the head-side chamber of the hydraulic cylinder is returned to the hydraulic fluid tank.

In the present invention configured as above, the necessary flow rate of the charge pump can be reduced in the hydraulic closed circuit at times of extension of the hydraulic cylinder, by which the charge system including the charge pump can be miniaturized and the energy saving performance and the mountability can be improved.

Further, the occurrence of cavitation at times of high-speed cylinder driving and the fluctuation in the cylinder operation speed at times of load direction inversion can be suppressed and shocks and vibrations can be reduced, by which the operability can be improved.

(2) Preferably, in the above hydraulic system (1), the proportional control valve is arranged in a hydraulic line that connects the delivery port of the open circuit hydraulic pump to the hydraulic fluid tank. The control unit switches the first switching valve to its open position and controls the proportional control valve at its closed position at times of extension of the hydraulic cylinder. The control unit switches the first switching valve to its open position and controls the proportional control valve at its open position at times of retraction of the hydraulic cylinder.

With this configuration, the cylinder speed can be increased at times of retraction of the hydraulic cylinder.

Further, the operability can be improved by reducing shocks and vibrations by suppressing the speed fluctuation at times of load direction inversion to the minimum at times of retraction of the hydraulic cylinder.

(3) Preferably, in the above hydraulic system (2), the control unit controls the delivery flow rate of the open circuit hydraulic pump so that at times of extension of the hydraulic cylinder the flow rate of the hydraulic fluid sent from the open circuit hydraulic pump to the head-side chamber of the hydraulic cylinder is determined based on the difference between a head-side chamber flow rate and a rod-side chamber flow rate which difference is caused by a pressure-receiving area difference between the head-side chamber and the rod-side chamber of the hydraulic cylinder.

With this configuration, the necessary flow rate of the charge pump in the hydraulic closed circuit can be reduced to substantially 0 at times of extension of the hydraulic cylinder at a steady speed, by which the charge system including the charge pump can be miniaturized and the energy saving performance and the mountability can be improved.

Further, the operability can be improved by reducing shocks and vibrations by suppressing the speed fluctuation at times of load direction inversion to the minimum at times of extension of the hydraulic cylinder.

(4) Preferably, in the above hydraulic system (2), the control unit at times of retraction of the hydraulic cylinder controls the proportional control valve so that the flow rate of the other part of the outward flow from the head-side chamber of the hydraulic cylinder returned to the hydraulic fluid tank is determined based on the difference between a head-side chamber flow rate and a rod-side chamber flow rate which difference is caused by a pressure-receiving area difference between the head-side chamber and the rod-side chamber of the hydraulic cylinder.

With this configuration, the cylinder speed can be increased at times of retraction of the hydraulic cylinder.

Further, the operability can be improved by reducing shocks and vibrations by suppressing the speed fluctuation at times of load direction inversion to the minimum at times of retraction of the hydraulic cylinder.

(5) Preferably, in the above hydraulic system (2), at times of retraction and regeneration operation of the hydraulic cylinder, when energy regenerated via the closed circuit hydraulic pump by returning the part of the outward flow from the head-side chamber of the hydraulic cylinder to the closed circuit hydraulic pump exceeds a permissible regeneration amount of the work machine, the control unit controls the proportional control valve so that part of the flow returned to the closed circuit hydraulic pump is returned to the hydraulic fluid tank.

With this configuration, the necessary cylinder speed can be secured even when the regenerated energy cannot be absorbed.

(6) Preferably, in the above hydraulic system (2), the proportional control valve is a flow control valve having a pressure compensation function.

With this configuration, it becomes possible to easily control the discharge flow rate of the proportional control valve at the target flow rate even when the head-side pressure of the hydraulic cylinder fluctuates at times of retraction of the hydraulic cylinder, by which excellent operability can be achieved.

(7) Preferably, in the above hydraulic system (1) or (2), the work machine is a hydraulic excavator equipped with a swing hydraulic motor and a boom cylinder, and the single rod hydraulic cylinder is the boom cylinder. Another open circuit hydraulic pump is provided separately from the open circuit hydraulic pump and the another open circuit hydraulic pump is connected to the swing hydraulic motor via a control valve.

With this configuration, the swing hydraulic motor is driven by the separately provided open circuit hydraulic pump. Accordingly, the necessary flow rate of the charge pump in the hydraulic closed circuit for driving the boom cylinder can be reduced even in combined operation of swinging and boom raising which is frequently performed on the hydraulic excavator. Consequently, the charge system including the charge pump can be miniaturized and the energy saving performance and the mountability can be improved.

Further, since the swing motor and the boom cylinder are driven by separate hydraulic pumps, the matching between the swinging operation and the boom raising operation becomes easier.

(8) Preferably, the above hydraulic system (1) or (2) comprises: a plurality of closed circuit hydraulic pumps including the closed circuit hydraulic pump; a plurality of open circuit hydraulic pumps including the open circuit hydraulic pump; a plurality of actuators including single rod hydraulic cylinders, including the single rod hydraulic cylinder, and another hydraulic actuator; a plurality of first switching valves including the first switching valve; and a plurality of proportional control valves including the proportional control valve. The closed circuit hydraulic pumps are connected to at least the single rod hydraulic cylinders included in the actuators via second switching valves. At least part of the open circuit hydraulic pumps are connected to the head-side chambers of the single rod hydraulic cylinders via the first switching valves. At least other part of the open circuit hydraulic pumps are connected to at least part of the another hydraulic actuator via a third switching valve. The proportional control valves are arranged respectively in hydraulic lines situated between the hydraulic fluid tank and the head-side chambers of the single rod hydraulic cylinders.

With this configuration, the hydraulic fluid can be supplied to one actuator from multiple hydraulic pumps. Therefore, the necessary actuator speed can be secured while also reducing the displacement per hydraulic pump especially when the hydraulic system is employed for a large-sized hydraulic excavator.

Further, by adjusting the number of hydraulic pumps performing the confluence assist according to the actuator speed, the hydraulic pumps can be used in regions where the pump efficiency is high, by which the energy saving performance of the work machine can be improved.

Effect of the Invention

According to the present invention, the energy saving performance and the mountability can be improved by miniaturizing the charge system by reducing the necessary flow rate of the charge pump in the hydraulic closed circuit for driving a single rod hydraulic cylinder with a bidirectional delivery hydraulic pump. Further, the operability can be improved by reducing shocks and vibrations by suppressing the occurrence of the cavitation at times of high-speed driving of the actuator and the fluctuation in the cylinder operation speed at times of load direction inversion.

BRIEF DESCRIPTION OF THE DRAWINGS

FIG. 3 is a table showing examples of control of pumps and valves when the hydraulic excavator equipped with the hydraulic system for a work machine in accordance with the first embodiment performs various operations.

MODE FOR CARRYING OUT THE INVENTION

Figure 1:
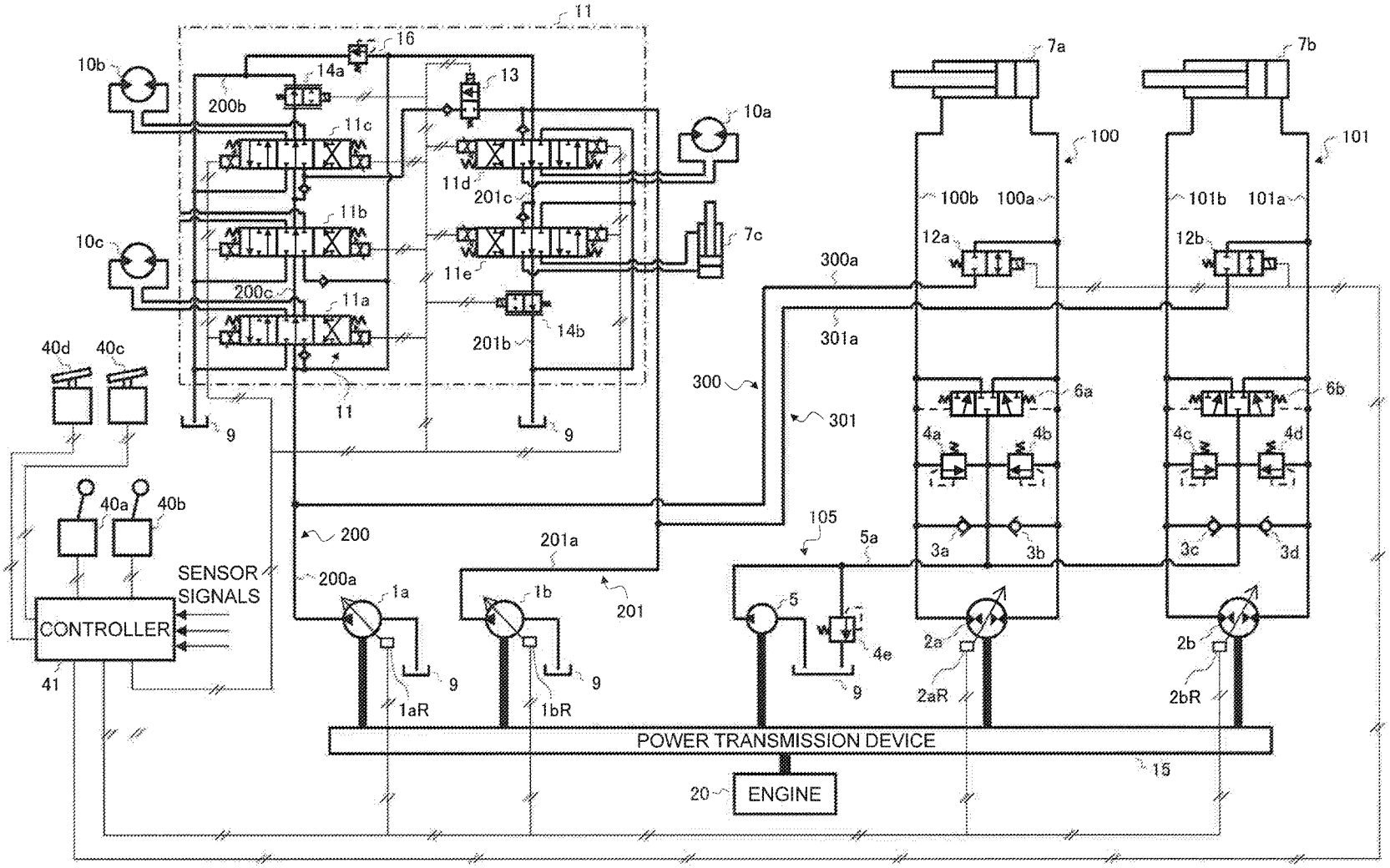
FIG. 1 is a hydraulic circuit diagram of a hydraulic system for a work machine in accordance with a first embodiment of the present invention.

Referring now to the drawings, a description will be given in detail of preferred embodiments in accordance with the present invention.

First Embodiment

—Configuration—

FIG. 1 is a schematic diagram showing the overall configuration of a hydraulic system in accordance with a first embodiment of the present invention.

In FIG. 1, the hydraulic system in this embodiment comprises hydraulic closed circuits 100 and 101, hydraulic open circuits 200 and 201, a hydraulic fluid tank 9, assist circuits 300 and 301, and a controller 41.

The hydraulic closed circuit 100 includes a closed circuit hydraulic pump 2*a* (hydraulic pump for the closed circuit) having two delivery ports and being capable of bidirectional delivery (hereinafter referred to as a "bidirectional delivery hydraulic pump 2*a*" as needed), an arm cylinder 7*a* as a single rod hydraulic cylinder, check valves 3*a* and 3*b*, relief valves 4*a* and 4*b*, and a flushing valve 6*a*. The bidirectional delivery hydraulic pump 2*a* is connected to the arm cylinder 7*a* in closed circuit connection via hydraulic lines 100*a* and 100*b*. The hydraulic pump 2*a* includes a regulator 2*a*R. The delivery direction and the delivery flow rate of the hydraulic pump 2*a* are controlled by actuating the regulator 2*a*R, by which the driving direction and the speed of the arm cylinder 7*a* are controlled. The check valves 3*a* and 3*b*, the relief valves 4*a* and 4*b* and the flushing valve 6*a* are connected between the hydraulic lines 100*a* and 100*b*. The check valves 3*a* and 3*b*, the relief valves 4*a* and 4*b* and the flushing valve 6*a* are connected also to a charge circuit 105 (charge system). The charge circuit 105 includes a charge pump 5, a hydraulic line 5*a* and a relief valve 4*e*. The relief valve 4*e* is connected to the hydraulic line 5*a* and controls the pressure in the hydraulic line 5*a* (delivery pressure of the charge pump 5) so that the pressure does not reach a preset pressure. The check valve 3*a*/3*b* prevents the cavitation by sucking in the hydraulic fluid from the charge circuit 105 when the pressure in the hydraulic line 100*a*/100*b* drops. The relief valve 4*a*/4*b* prevents damage to the piping of the hydraulic line 100*a*/100*b* and hydraulic equipment (e.g., hydraulic pump 2*a*) by releasing the hydraulic fluid to the charge circuit 105 when the pressure in the hydraulic line 100*a*/100*b* reaches a preset pressure. The flushing valve 6*a* is a low-pressure selection valve for absorbing a flow rate difference (explained later) accompanying the reciprocating motion of the arm cylinder 7*a*. The flushing valve 6*a* serves to supplement the hydraulic line 100*a* or 100*b* on the low pressure side with a deficit flow supplied from the charge circuit 105 or to discharge a surplus flow from the hydraulic line on the low pressure side to the hydraulic fluid tank 9 via the relief valve 4*e* of the charge circuit 105.

The hydraulic closed circuit 101 includes a closed circuit hydraulic pump 2*b* having two delivery ports and being capable of bidirectional delivery (hereinafter referred to as a "bidirectional delivery hydraulic pump 2*b*"), a boom cylinder 7*b* as a single rod hydraulic cylinder, check valves 3*c* and 3*d*, relief valves 4*c* and 4*d*, and a flushing valve 6*b*. The bidirectional delivery hydraulic pump 2*b* is connected to the boom cylinder 7*b* in closed circuit connection via hydraulic lines 101*a* and 101*b*. The hydraulic pump 2*b* includes a regulator 2*b*R. The delivery direction and the delivery flow rate of the hydraulic pump 2*b* are controlled by actuating the regulator 2*b*R, by which the driving direction and the speed of the boom cylinder 7*b* are controlled. The check valves 3*c* and 3*d*, the relief valves 4*c* and 4*d* and the flushing valve 6*b* are connected between the hydraulic lines 101*a* and 101*b*. The check valves 3*c* and 3*d*, the relief valves 4*c* and 4*d* and the flushing valve 6*b* are connected also to the charge circuit 105. The check valve 3*c*/3*d* prevents the cavitation by sucking in the hydraulic fluid from the charge circuit 105 when the pressure in the hydraulic line 101*a*/101*b* drops. The relief valve 4*c*/4*d* prevents damage to the piping of the hydraulic line 101*a*/101*b* and hydraulic equipment (e.g., hydraulic pump 2*b*) by releasing the hydraulic fluid to the charge circuit 105 when the pressure in the hydraulic line 101*a*/101*b* reaches a preset pressure. The flushing valve 6*b* is a low-pressure selection valve for absorbing a flow rate difference (explained later) accompanying the reciprocating motion of the boom cylinder 7*b*. The flushing valve 6*b* serves to supplement the hydraulic line 101*a* or 101*b* on the low pressure side with a deficit flow supplied from the charge circuit 105 or to discharge a surplus flow from the hydraulic line on the low pressure side to the hydraulic fluid tank 9 via the relief valve 4*e* of the charge circuit 105.

The hydraulic open circuit 200 includes an open circuit hydraulic pump 1*a* (hydraulic pump for the open circuit) having a suction port for sucking in the hydraulic fluid from the hydraulic fluid tank 9 and a delivery port for delivering the hydraulic fluid, spool valves 11*a*-11*c*, a left travel hydraulic motor 10*b*, and a swing hydraulic motor 10*c*. The hydraulic pump 1*a* is connected to the hydraulic actuators 10*c* and 10*b* via a hydraulic fluid supply line 200*a* and the spool valves 11*a* and 11*c*. The hydraulic pump 1*a* includes a regulator 1*a*R. The delivery flow rate of the hydraulic pump 1*a* is controlled by actuating the regulator 1*a*R. When the spool valve 11*a*/11*c* is operated from its neutral position, the hydraulic fluid delivered from the hydraulic pump 1*a* is supplied to the hydraulic actuator 10*c*/10*b* via the hydraulic fluid supply line 200*a* and the spool valve 11*a*/11*c*. The hydraulic fluid returning from the hydraulic actuator 10*c*/10*b* is returned to the hydraulic fluid tank 9 via the spool valve 11*a*/11*c*. The flow direction and the flow rate of the hydraulic fluid supplied to the hydraulic actuator 10*c*/10*b* are controlled by operating the spool valve 11*a*/11*c*, by which the driving direction and the speed of the hydraulic actuator 10*c*/10*b* are controlled. The spool valve 11*b* is a spare to be used when another hydraulic actuator is added. The spool valves 11*a*-11*c* are flow control valves of the open center type. The spool valves 11*a*-11*c* are arranged in line in a center bypass hydraulic line 200*c*. The upstream end of the center bypass hydraulic line 200*c* is connected to the hydraulic fluid supply line 200*a*, while the downstream end of the center bypass hydraulic line 200*c* is connected to the hydraulic fluid tank 9 via a hydraulic fluid return line 200*b*.

The hydraulic open circuit 201 includes an open circuit hydraulic pump 1*b* having a suction port for sucking in the hydraulic fluid from the hydraulic fluid tank 9 and a delivery port for delivering the hydraulic fluid, spool valves 11*d* and 11*e*, a right travel hydraulic motor 10*a*, and a bucket cylinder 7*c*. The hydraulic pump 1*b* is connected to the right travel hydraulic motor 10*a* and the bucket cylinder 7*c* via a hydraulic fluid supply line 201*a* and the spool valves 11*d* and 11*e*. The hydraulic pump 1*b* includes a regulator 1*b*R. The delivery flow rate of the hydraulic pump 1*b* is controlled by actuating the regulator 1*br*. When the spool valve 11*d*/11*e* is operated from its neutral position, the hydraulic fluid delivered from the hydraulic pump 1*b* is supplied to the hydraulic actuator 10*a*/7*c* via the hydraulic fluid supply line 201*a* and the spool valve 11*d*/11*e*. The hydraulic fluid returning from the hydraulic actuator 10*a*/7*c* is returned to the hydraulic fluid tank 9 via the spool valve 11*d*/11*e*. The flow direction and the flow rate of the hydraulic fluid supplied to the hydraulic actuator 10*a*/7*c* are controlled by operating the spool valve 11*d*/11*e*, by which the driving direction and the speed of the hydraulic actuator 10*a*/7*c* are controlled. The spool valves 11*d* and 11*e* are flow control valves of the open center type. The spool valves 11*d* and 11*e* are arranged in line in a center bypass hydraulic line 201*c*. The upstream end of the center bypass hydraulic line 201*c* is connected to the hydraulic fluid supply line 201*a*, while the downstream end of the center bypass hydraulic line 201*c* is connected to the hydraulic fluid tank 9 via a return line 201*b*.

The hydraulic fluid supply line 200*a* of the hydraulic open circuit 200 and the hydraulic fluid supply line 201*a* of the hydraulic open circuit 201 are provided with a common high-pressure relief valve 16 and are connected to the hydraulic fluid tank 9 via the high-pressure relief valve 16. The high-pressure relief valve 16 prevents damage to the piping of the hydraulic line 200*a*/201*a* and hydraulic equipment (e.g., hydraulic pump 1*a*/1*b*) by releasing the hydraulic fluid to the hydraulic fluid tank 9 when the delivery pressure of the hydraulic pump 1*a*/1*b* reaches a preset pressure. The hydraulic fluid supply line 201*a* is connected to a meter-in hydraulic line of the spool valve 11*c* of the hydraulic open circuit 200 via a confluence valve 13. The confluence valve 13 serves to maintain the straight traveling property of the work machine by switching from an open position to a closed position and supplying the hydraulic fluid delivered from the hydraulic pump 1*b* to both the spool valves 11*c* and 11*d* when a non-travel actuator (actuator for a purpose other than the traveling of the work machine) is driven during the traveling of the work machine (travel combined operation).

The assist circuit 300 includes a hydraulic line 300*a* which connects the hydraulic line 100*a* (connected to a head-side chamber of the arm cylinder 7*a*) to the hydraulic fluid supply line 200*a* and a switching valve 12*a* of the normally closed type (first switching valve) which is arranged in the hydraulic line 300*a*. The assist circuit 301 includes a hydraulic line 301*a* which connects the hydraulic line 101*a* (connected to a head-side chamber of the boom cylinder 7*b*) to the hydraulic fluid supply line 201*a* and a switching valve 12*b* of the normally closed type (first switching valve) which is arranged in the hydraulic line 301*a*. The switching valves 12*a* and 12*b* are solenoid valves that are switched by electric signals outputted from the controller 41. When the switching valve 12*a*/12*b* is switched from the illustrated closed position to an open position, the hydraulic line 100*a*/101*a* is connected to the hydraulic fluid supply line 200*a*/201*a*.

The assist circuit 300 further includes a proportional control valve 14*a* of the normally open type which is arranged downstream of the spool valve 11*c* at the downstream end of the center bypass hydraulic line 200*c*. The assist circuit 301 further includes a proportional control valve 14*b* of the normally open type which is arranged downstream of the spool valve 11*e* at the downstream end of the center bypass hydraulic line 201*c*. The proportional control valves 14*a* and 14*b* are solenoid valves that change their opening areas continuously according to electric signals outputted from the controller 41. When the proportional control valve 14*a* is at the illustrated full open position and the spool valves 11*a*-11*c* are at the illustrated neutral positions, the hydraulic fluid supply line 200*a* is connected to the hydraulic fluid tank 9 via the hydraulic lines 200*c* and 200*b* and the hydraulic fluid delivered from the hydraulic pump 1*a* is returned to the hydraulic fluid tank 9. Similarly, when the proportional control valve 14*b* is at the illustrated full open position and the spool valves 11*d* and 11*e* are at the illustrated neutral positions, the hydraulic fluid supply line 201*a* is connected to the hydraulic fluid tank 9 via the hydraulic lines 201*c* and 201*b* and the hydraulic fluid delivered from the hydraulic pump 1*b* is returned to the hydraulic fluid tank 9.

The spool valves 11*a*-11*c*, the spool valves 11*d* and 11*e*, the confluence valve 13, the high-pressure relief valve 16 and the proportional control valves 14*a* and 14*b* constitute a control valve 11.

Each operation device 40*a*, 40*b* is an operation device of the control lever type, having a control lever that can be operated in the longitudinal direction and the transverse direction. The operation device 40*a* is used for controlling the swinging and the arm, for example. The operation device 40*b* is used for controlling the boom and the bucket, for example. When the control lever of the operation device 40*a* is operated in the longitudinal direction, the spool valve 11*a* is operated and the swing hydraulic motor 10*c* is driven according to the operation amount of the control lever. When the control lever of the operation device 40*a* is operated in the transverse direction, the regulator 2*a*R of the closed circuit hydraulic pump 2*a* is operated and the arm cylinder 7*a* is driven according to the operation amount of the control lever. When the control lever of the operation device 40*b* is operated in the longitudinal direction, the regulator 2$b$R of the closed circuit hydraulic pump 2$b$ is operated and the boom cylinder 7$b$ is driven according to the operation amount of the control lever. When the control lever of the operation device 40$b$ is operated in the transverse direction, the spool valve 11$e$ is operated and the bucket cylinder 7$c$ is driven according to the operation amount of the control lever. Incidentally, the correspondence between the operating directions of the control levers of the operation devices 40$a$ and 40$b$ and the hydraulic actuators driven by the lever operation is not restricted to the above example.

Each operation device 40$c$, 40$d$ is a travel operation device of the control pedal type. When a pedal of the operation device 40$c$/40$d$ is operated, the spool valve 11$d$/11$c$ is operated and the right/left travel hydraulic motor 10$a$/10$b$ is driven according to the operation amount of the pedal.

The controller 41 receives operation signals from the operation devices 40$a$-40$d$ as input signals, performs a prescribed calculation process, and outputs electric signals obtained by the calculation process (control signals) to the regulators 1$a$R, 1$b$R, 2$a$R and 2$b$R of the hydraulic pumps 1$a$, 1$b$, 2$a$ and 2$b$, the spool valves 11$a$-11$e$, the switching valves 12$a$ and 12$b$, the confluence valve 13 and the proportional control valves 14$a$ and 14$b$ to control these components.

The hydraulic system in this embodiment comprises a power system including an engine 20 and a power transmission device 15 connected to the engine 20. The engine 20 drives the hydraulic pumps 1$a$, 1$b$, 2$a$ and 2$b$ and the charge pump 5 via the power transmission device 15.

Figure 2:
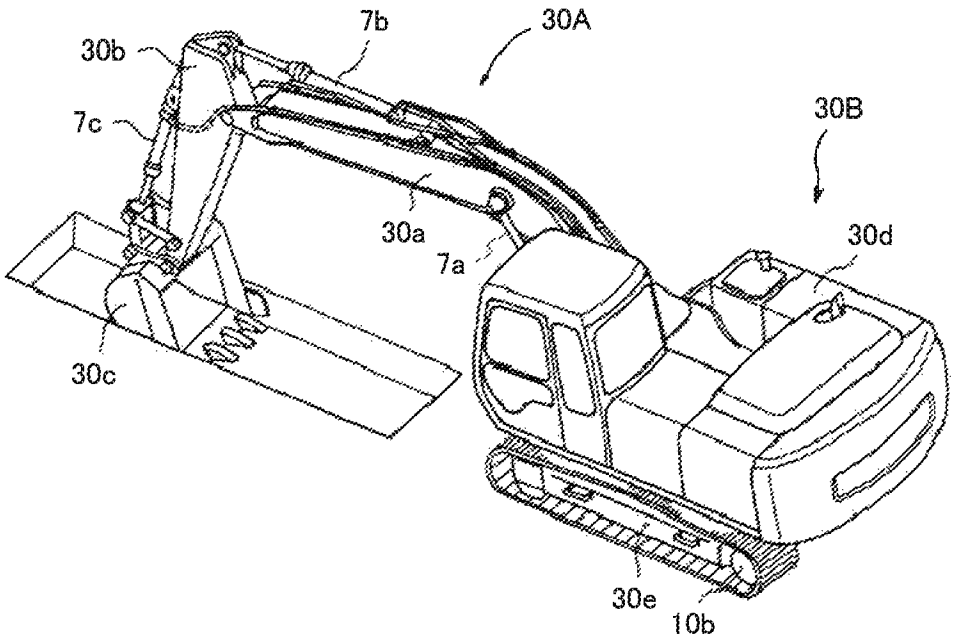
FIG. 2 is a schematic diagram showing the external appearance of a hydraulic excavator as an example of the work machine.

FIG. 2 shows the external appearance of a hydraulic excavator as an example of the work machine equipped with the hydraulic system of this embodiment. In FIG. 2, components equivalent to those shown in FIG. 1 are assigned the same reference characters. The hydraulic excavator comprises an upper swing structure 30$d$, a lower track structure 30$e$ and a front work implement 30A. The lower track structure 30$e$ travels by using the driving force of the right and left travel hydraulic motors 10$a$ and 10$b$ (only one side is shown in FIG. 2). The upper swing structure 30$d$ is swung (rotated) on the lower track structure 30$e$ by the swing hydraulic motor 10$c$ (FIG. 1). The front work implement 30A is a multijoint structure including a boom 30$a$, an arm 30$b$ and a bucket 30$c$. The boom 30$a$, the arm 30$b$ and the bucket 30$c$ are driven vertically or forward and backward by the boom cylinder 7$b$, the arm cylinder 7$a$ and the bucket cylinder 7$c$, respectively.

—Operation—

The operation of each actuator in the hydraulic system configured as above will be explained below by referring to FIGS. 3-6. FIG. 3 is a table showing examples of the operation of the hydraulic pumps 1$a$, 1$b$, 2$a$ and 2$b$, the switching valves 12$a$ and 12$b$, and the proportional control valves 14$a$ and 14$b$ when various operations of the hydraulic excavator are performed. When a boom raising operation (single operation 1) is performed, for example, the switching valve 12$b$ (normally closed) is opened (ON), both the open circuit hydraulic pump 1$b$ and the closed circuit hydraulic pump 2$b$ are driven (ON), and the valve open angle of the proportional control valve 14$b$ (normally open) is controlled (ON) as shown in FIG. 3.

——Boom Single Operation——

Figure 4:
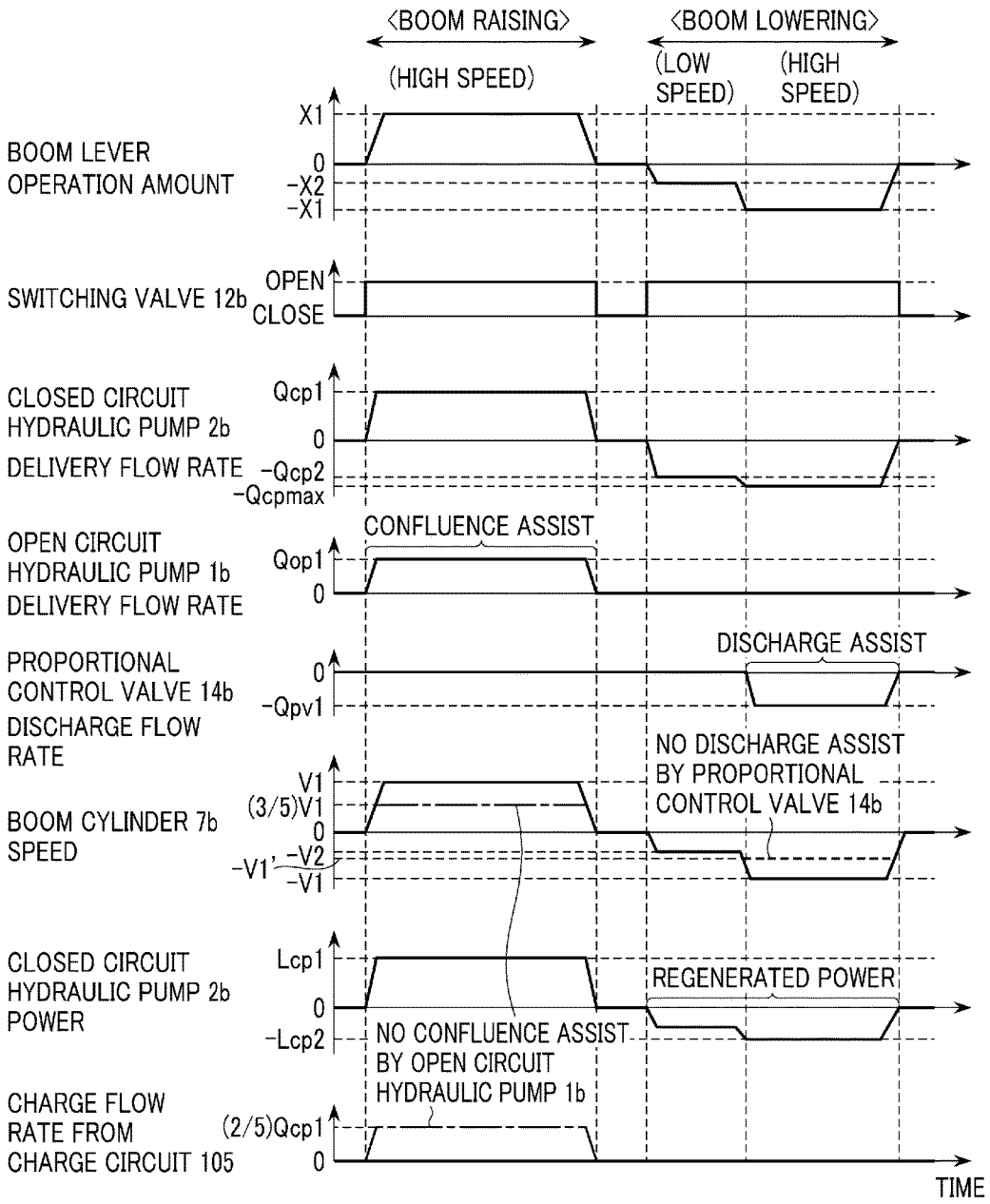
FIG. 4 is a timing chart showing the time history response of a pump flow rate, etc. in response to the operator's lever operation in boom operations in the hydraulic excavator equipped with the hydraulic system for a work machine in accordance with the first embodiment.

A boom single operation will be explained below by referring to FIGS. 3 and 4. FIG. 4 is a timing chart showing the time history response of the switching valve 12$b$, the hydraulic pumps 1$b$ and 2$b$, the proportional control valve 14$b$, the boom cylinder 7$b$ and the charge circuit 105 in response to the operation amount of the control lever of the operation device 40$b$ in the longitudinal direction (hereinafter referred to as a "boom lever operation amount") in operations of boom raising (high speed), boom lowering (low speed) and boom lowering (high speed). In FIG. 4, the boom lever operation amount, the delivery flow rate of the hydraulic pump 2$b$, the speed of the boom cylinder 7$b$ and the power of the hydraulic pump 2$b$ are indicated as positive values when the boom cylinder 7$b$ expands and as negative values when the boom cylinder 7$b$ contracts.

———Boom Raising (High Speed)———

In the boom raising (high speed), concurrently with the operation on the control lever of the operation device 40$b$ in the longitudinal direction (hereinafter referred to as a "boom lever operation"), the switching valve 12$b$ is opened (ON), the valve open angle of the proportional control valve 14$b$ is controlled in a closing direction (ON), the closed circuit hydraulic pump 2$b$ and the open circuit hydraulic pump 1$b$ are driven (ON) (single operation 1 in FIG. 3), and a flow of the hydraulic fluid corresponding to the boom lever operation amount X1 is sent to the head-side chamber of the boom cylinder 7$b$ from both the closed circuit hydraulic pump 2$b$ and the open circuit hydraulic pump 1$b$ (confluence assist). Accordingly, the boom cylinder expands at a speed V1. In this case, the controller 41 controls the delivery flow rate of the open circuit hydraulic pump 1$b$ so that the flow rate of the hydraulic fluid sent from the open circuit hydraulic pump 1$b$ to the head-side chamber of the boom cylinder 7$b$ is determined based on the difference between a head-side chamber flow rate and a rod-side chamber flow rate the difference is caused by the pressure-receiving area difference between the head-side chamber and the rod-side chamber of the boom cylinder 7$b$.

Here, an explanation will be given of an example in which the controller 41 controls the delivery flow rate of the open circuit hydraulic pump 1$b$ so that the flow rate of the hydraulic fluid sent from the open circuit hydraulic pump 1$b$ to the head-side chamber of the boom cylinder 7$b$ equals the difference between the head-side chamber flow rate and the rod-side chamber flow rate caused by the pressure-receiving area difference between the head-side chamber and the rod-side chamber of the boom cylinder 7$b$. The pressure-receiving areas of the head-side chamber and the rod-side chamber of the boom cylinder 7$b$ will be expressed as Ah and Ar, respectively. The delivery flow rates of the closed circuit hydraulic pump 2$b$ and the open circuit hydraulic pump 1$b$ will be expressed as Qcp1 and Qop1, respectively. Since the head-side chamber flow rate equals Qcp1+Qop1 and the rod-side chamber flow rate equals (Qcp1+Qop1)×Ar/Ah, the difference between these flow rates equals (Qcp1+Qop1)×(1−Ar/Ah). Thus, the delivery flow rate Qop1 of the open circuit hydraulic pump 1$b$ is controlled to satisfy:

$$Qop1=(Qcp1+Qop1)\times(1-Ar/Ah) \tag{1}$$

The above expression (1) can be transformed into:

$$Qcp1:Qop1=Ar:(Ah-Ar) \tag{2}$$

and $$Qop1=Qcp1\times(Ah/Ar-1) \tag{3}$$

This means that the delivery flow rate Qop1 of the open circuit hydraulic pump 1$b$ is controlled to maintain the relationship of the expression (2) or (3). For example, when a cylinder satisfying Ah:Ar=5:3 is used, Qop1 equals 200

L/min when Qcp1 equals 300 L/min. Since the head-side chamber flow rate is 500 L/min and the rod-side chamber flow rate is 300 L/min in this case, a flow equal to the flow delivered from the closed circuit hydraulic pump 2*b* returns from the rod-side chamber to the intake side of the hydraulic pump 2*b*. Since no flow rate insufficiency occurs in the hydraulic closed circuit 101, the charge flow rate from the charge circuit 105 is allowed to be 0 and the displacement (capacity) of the charge pump 5 can be made extremely small.

Suppose there is no confluence assist from the open circuit hydraulic pump 1*b* to the head-side chamber, the speed of the boom cylinder 7*b* drops as indicated by the chain line in FIG. 4 and the charge flow from the charge circuit 105 becomes necessary. Specifically, since the head-side flow rate of the boom cylinder 7*b* becomes equal to the delivery flow rate Qcp1 (=300 L/min) of the closed circuit hydraulic pump 2*b*, the extension speed of the boom cylinder 7*b* drops to (3/5)V1. Further, since the rod-side flow rate of the boom cylinder 7*b* equals (3/5)Qcp1=180 L/min and the delivery flow rate Qcp1 of the closed circuit hydraulic pump 2*b* equals 300 L/min, a flow rate insufficiency of (2/5)Qcp1=120 L/min occurs in the hydraulic closed circuit 101 and the same amount of charge flow from the charge circuit 105 becomes necessary.

Incidentally, while the above explanation has been given of the case where the assist flow rate from the open circuit hydraulic pump 1*b* is controlled to be equal to the difference between the head-side chamber flow rate and the rod-side chamber flow rate, this embodiment is effective also when the assist flow rate from the open circuit hydraulic pump 1*b* is controlled to be higher or lower than the difference. This will be explained in detail below. In the boom raising operation, the hydraulic line 101*a* becomes the high pressure side, and thus the hydraulic line 101*b* on the low pressure side and the charge circuit 105 are connected together via the flushing valve 6*b*. In the case where the assist flow rate from the open circuit hydraulic pump 1*b* is controlled to be higher than the difference, the discharge flow rate from the rod-side chamber increases with the increase in the supply flow rate to the head-side chamber. However, since this excess discharge flow is discharged to the tank 9 via the flushing valve 6*b* and the charge circuit 105, a flow equal to the flow delivered from the closed circuit hydraulic pump 2*b* returns from the rod-side chamber to the intake side of the hydraulic pump 2*b*. Consequently, the charge flow rate from the charge circuit 105 is allowed to be 0 without causing any hydraulic circuit failure. On the other hand, in the case where the assist flow rate from the open circuit hydraulic pump 1*b* is controlled to be lower than the difference, the discharge flow rate from the rod-side chamber becomes insufficient with the decrease in the supply flow rate to the head-side chamber. However, since a charge flow corresponding to the insufficiency in the discharge flow rate is supplied to the hydraulic line 101*b* via the charge circuit 105 and the flushing valve 6*b*, a flow equal to the flow delivered from the closed circuit hydraulic pump 2*b* returns from the rod-side chamber to the intake side of the hydraulic pump 2*b*. Consequently, the charge flow rate from the charge circuit 105 is allowed to be far lower than that in the case where no assist is given, without causing any hydraulic circuit failure. Thus, the displacement (capacity) of the charge pump 5 can be made extremely small similarly to the case where the assist flow rate from the open circuit hydraulic pump 1*b* is equal to the difference. Incidentally, since the speed of the boom cylinder 7*b* changes (from the speed corresponding to the boom lever operation amount X1) according to the increment/decrement in the assist flow rate from the open circuit hydraulic pump 1*b* with respect to the difference, it is desirable to set the increment/decrement (in the assist flow rate from the open circuit hydraulic pump 1*b* with respect to the difference) within a range in which bad influence on the operability, etc. is slight. It goes without saying that this embodiment is effective also when the increment/decrement in the assist flow rate from the open circuit hydraulic pump 1*b* with respect to the difference has changed due to secular change.

While the above explanation has been given of the operation and the control when the boom raising (high speed) is performed, the operation and the control in cases of low speed are similar to those explained above.

———Boom Lowering (Low Speed)———

In the boom lowering (low speed), concurrently with the boom lever operation, only the closed circuit hydraulic pump 2*b* is driven (ON) (single operation 2 in FIG. 3) and a flow −Qcp2 corresponding to the boom lever operation amount X2 is sucked in from the head-side chamber of the boom cylinder 7*b* and discharged to the rod side. The difference between the delivery flow −Qcp2 of the closed circuit hydraulic pump 2*b* and the flow supplied to the rod-side chamber of the boom cylinder 7*b* is discharged from the flushing valve 6*b* and returned to the hydraulic fluid tank 9. Accordingly, the boom cylinder contracts at a speed −V2. In the boom lowering operation, the closed circuit hydraulic pump 2*b* is driven as a motor by the outward flow from the head-side chamber of the boom cylinder 7*b* and recovers the potential energy of the boom (energy regeneration), and thus the pump power becomes negative. This negative power (regenerated power) is transmitted to the engine 20 via the power transmission device 15 and decreases the engine load. The engine control is generally performed to increase/decrease the fuel consumption according to the engine load in order to maintain the engine revolution speed at a constant level. Therefore, the fuel consumption can be reduced by decreasing the engine load as above.

———Boom Lowering (High Speed)———

In the boom lowering (high speed), concurrently with the boom lever operation, the switching valve 12*b* is opened (ON), the valve open angle of the proportional control valve 14*b* is controlled in the opening direction (ON) when the boom lever operation amount has reached a prescribed amount (see FIG. 6B), only the closed circuit hydraulic pump 2*b* is driven (ON) (single operation 3 in FIG. 3), and a maximum flow −Qcpmax is sucked in by the closed circuit hydraulic pump 2*b* from the head-side chamber of the boom cylinder 7*b* and discharged to the rod side while a flow −Qpv1 corresponding to the boom lever operation amount X1 is discharged from the proportional control valve 14*b* and returned to the hydraulic fluid tank 9 (discharge assist), by which the cylinder speed is increased. Accordingly, the boom cylinder 7*b* contracts at a speed −V1. In this case, the controller 41 controls the valve open angle of the proportional control valve 14*b* so that the proportional control valve 14*b* discharges a flow corresponding to the boom lever operation amount X1. Since the discharge flow rate of the proportional control valve 14*b* changes according to the head-side pressure of the boom cylinder 7*b*, it is desirable to adjust the valve open angle according to the head-side pressure, or to employ a flow control valve having the pressure compensation function as the proportional control valve 14*b*. This makes it possible to stably discharge a flow corresponding to the boom lever operation amount to the hydraulic fluid tank 9 even when the load status of the boom fluctuates. Consequently, quick and excellent operability can be achieved.

Incidentally, when the discharge assist by the proportional control valve 14*b* is absent, the outward flow rate from the head-side chamber of the boom cylinder 7*b* is limited to the maximum delivery flow rate −Qcpmax of the closed circuit hydraulic pump 2*b* or less and the retraction speed of the boom cylinder 7*b* cannot be increased over −V1'=−V1×(Qcpmax/(Qcpmax+Qpv1)) as indicated by the dotted line in FIG. 4. Consequently, the boom lowering speed is limited.

The boom raising is performed by merging together the delivery flows from the closed circuit hydraulic pump 2*b* and the open circuit hydraulic pump 1*b*, whereas the boom lowering (low speed) is performed by using the closed circuit hydraulic pump 2*b* only. Therefore, if the ratio of the delivery flow rate of the closed circuit hydraulic pump 2*b* to the boom lever operation amount is set equally for the boom raising and the boom lowering, the cylinder speed varies between the boom raising and the boom lowering even if the boom lever operation amount is the same, which is undesirable in terms of operability. This problem can be resolved by setting the ratio (of the delivery flow rate of the closed circuit hydraulic pump 2*b* to the boom lever operation amount) in the boom lowering higher than the ratio in the boom raising.

Figure 6A:
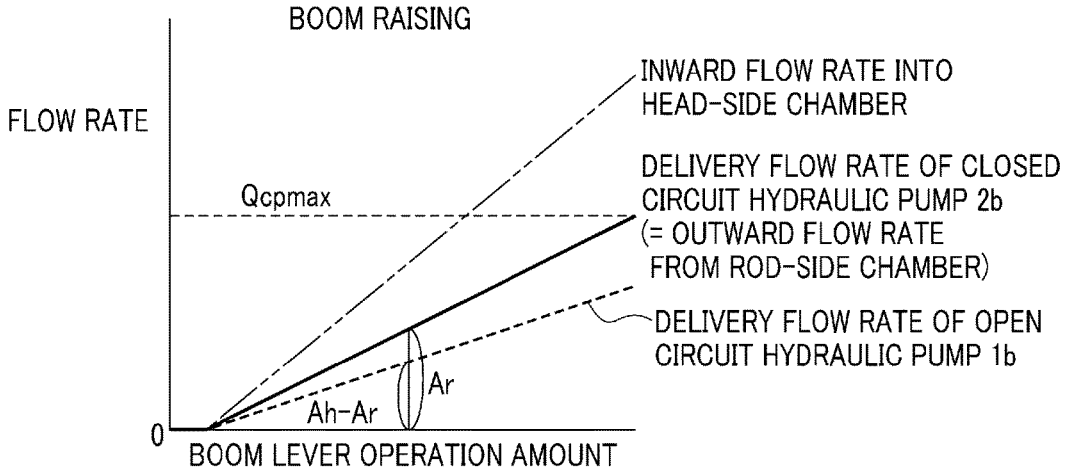
FIG. 6A is a graph showing the relationship between a boom lever operation amount in boom raising and a pump flow rate, etc. in the hydraulic excavator equipped with the hydraulic system for a work machine in accordance with the first embodiment.
Figure 6B:
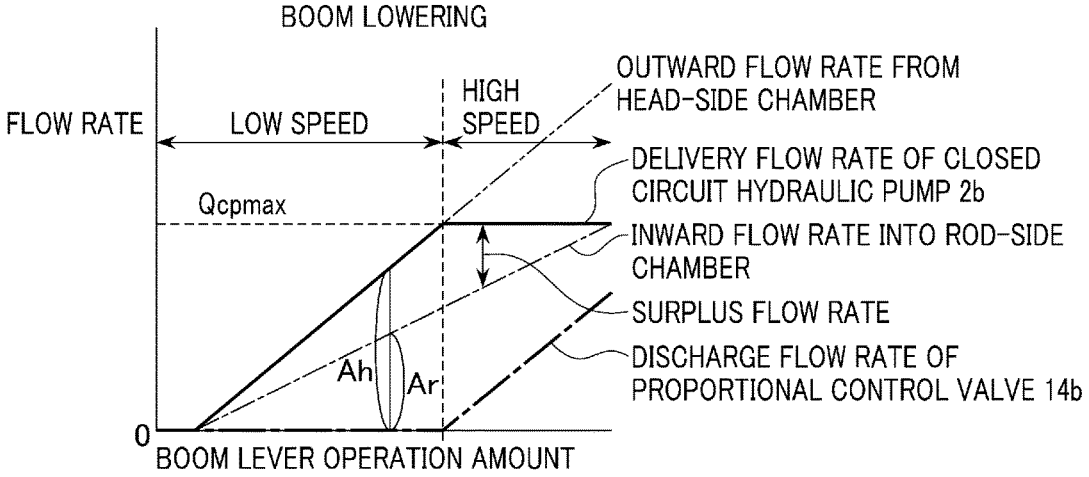
FIG. 6B is a graph showing the relationship between the boom lever operation amount in boom lowering and a pump flow rate, etc. in the hydraulic excavator equipped with the hydraulic system for a work machine in accordance with the first embodiment.

FIG. 6A is a graph showing the relationship between the boom lever operation amount in the boom raising and the delivery flow rates of the hydraulic pumps 1*b* and 2*b*. FIG. 6B is a graph showing the relationship between the boom lever operation amount in the boom lowering, the delivery flow rates of the hydraulic pumps 1*b* and 2*b*, and the discharge flow rate of the proportional control valve 14*b*. In the boom raising shown in FIG. 6A, the delivery flow rate of the closed circuit hydraulic pump 2*b* and the delivery flow rate of the open circuit hydraulic pump 1*b* are increased proportionally to the boom lever operation amount while keeping the ratio between the delivery flow rates at Ar:(Ah−Ar). In the boom lowering shown in FIG. 6B, at times of low-speed driving when the boom lever operation amount is small, the closed circuit hydraulic pump 2*b* delivers a flow equal to the total flow that is delivered from the hydraulic pumps 1*b* and 2*b* when the boom raising is performed with the same lever operation amount. After the boom lever operation amount has increased and the delivery flow rate of the closed circuit hydraulic pump 2*b* has reached the maximum delivery flow rate Qcpmax (high-speed driving), the proportional control valve 14*b* is opened (ON) and each flow rate is controlled so that the gradient of the outward flow rate from the head-side chamber (=delivery flow rate of the closed circuit hydraulic pump 2*b*+discharge flow rate of the proportional control valve 14*b*) with respect to the boom lever operation amount remains constant. This makes it possible to keep the ratio of the cylinder speed to the boom lever operation amount at a constant ratio from low-speed driving (small operation amount) to high-speed driving (large operation amount) in both the boom raising and the boom lowering. Consequently, excellent operability can be achieved.

Incidentally, while the discharge assist by the proportional control valve 14*b* in the above example is performed when the delivery flow rate of the closed circuit hydraulic pump 2*b* in the boom lowering operation exceeds the maximum delivery flow rate −Qcpmax, the discharge assist may also be performed in other cases. For example, there are cases where the regenerated energy in the boom lowering operation is too high and cannot be absorbed by the decrease in the fuel injection quantity of the engine alone. In such cases, when the engine revolution speed increases too much (runaway), the hydraulic energy regenerated by the closed circuit hydraulic pump 2*b* is reduced by performing the discharge assist by opening the switching valve 12*b* and the proportional control valve 14*b* even if the delivery flow rate of the closed circuit hydraulic pump 2*b* is within the maximum flow rate −Qcpmax.

By the above operation, the energy regeneration can be conducted to the fullest extent while preventing the runaway (over-rev) of the engine and securing a necessary boom lowering speed. This embodiment is effective also in cases where the electric energy obtained by rotating the generator with the closed circuit hydraulic pump is stored in a battery or capacitor (energy storage means); it is unnecessary to limit the boom lowering speed even when the battery or capacitor has been fully charged.

——Arm Single Operation——

Figure 5:
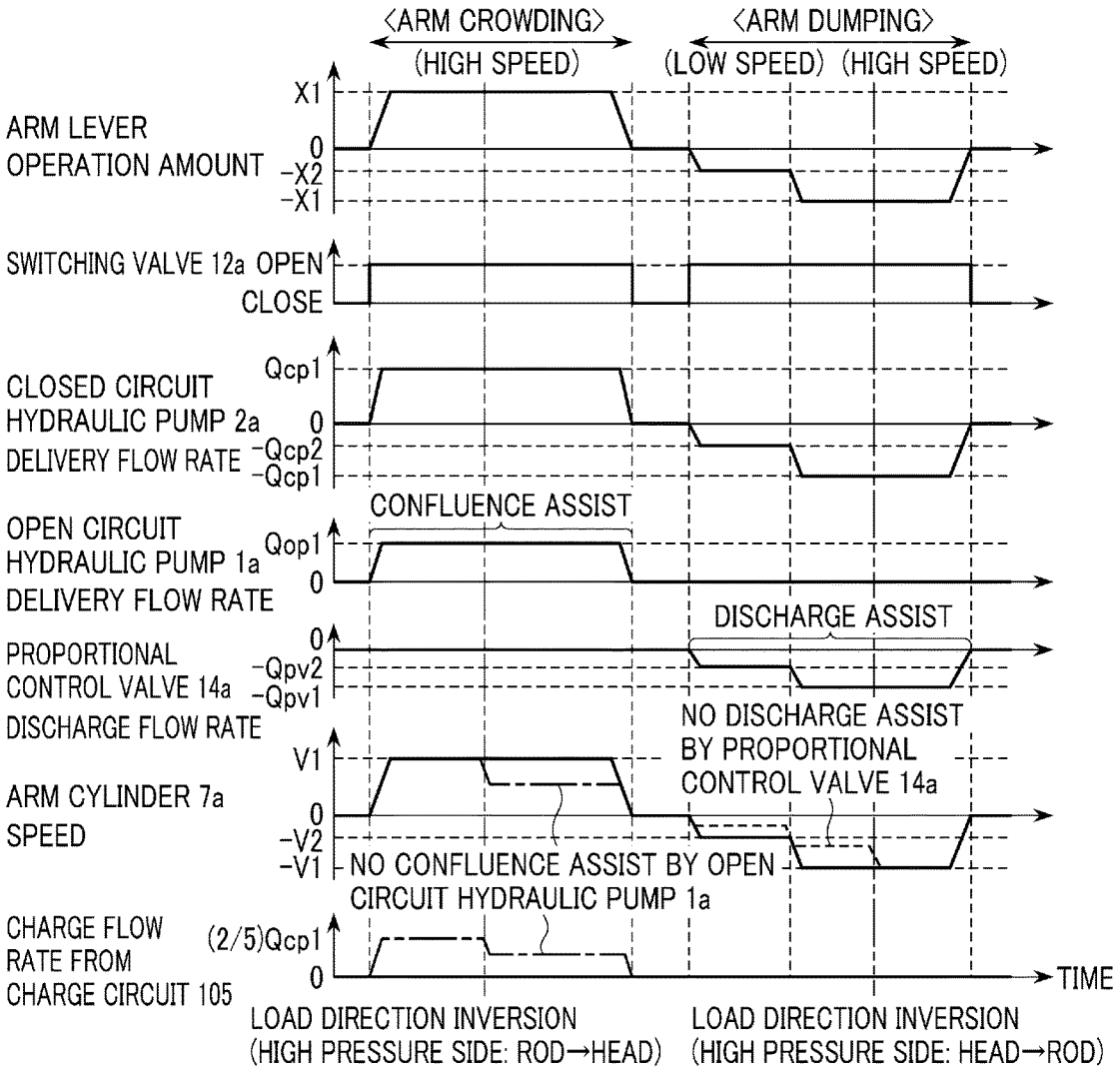
FIG. 5 is a timing chart showing the time history response of a pump flow rate, etc. in response to the operator's lever operation in arm operations in the hydraulic excavator equipped with the hydraulic system for a work machine in accordance with the first embodiment.

Next, an arm single operation will be explained below by referring to FIGS. 3 and 5. FIG. 5 is a timing chart showing the time history response of the switching valve 12*a*, the hydraulic pumps 1*a* and 2*a*, the proportional control valve 14*a*, the arm cylinder 7*a* and the charge circuit 105 in response to the operation amount of the control lever of the operation device 40*a* in the transverse direction (hereinafter referred to as an "arm lever operation amount") in operations of arm crowding (high speed), arm dumping (low speed) and arm dumping (high speed). In FIG. 5, the arm lever operation amount, the delivery flow rate of the hydraulic pump 2*a* and the speed of the arm cylinder 7*a* are indicated as positive values when the arm cylinder 7*a* expands and as negative values when the arm cylinder 7*a* contracts.

———Arm Crowding———

In the arm crowding (performed similarly to the boom raising), concurrently with the operation on the control lever of the operation device 40*a* in the transverse direction (hereinafter referred to as an "arm lever operation"), the switching valve 12*a* is opened (ON), the proportional control valve 14*a* is controlled in the closing direction (ON), the open circuit hydraulic pump 1*a* and the closed circuit hydraulic pump 2*a* are driven (ON) (single operation 5 in FIG. 3), and a flow of the hydraulic fluid corresponding to the arm lever operation amount X1 is sent to the head-side chamber of the arm cylinder 7*a* from both the closed circuit hydraulic pump 2*a* and the open circuit hydraulic pump 1*a* (confluence assist). In this case, the controller 41 controls the delivery flow rate of the open circuit hydraulic pump 1*a* so that the flow rate of the hydraulic fluid sent from the open circuit hydraulic pump 1*a* to the head-side chamber of the arm cylinder 7*a* is determined based on the difference between a head-side chamber flow rate and a rod-side chamber flow rate which difference is caused by the pressure-receiving area difference between the head-side chamber and the rod-side chamber of the arm cylinder 7*a*. Accordingly, the arm cylinder 7*a* expands at a speed V1 corresponding to the arm lever operation amount X1 and the charge flow rate from the charge circuit 105 can be kept at 0 similarly to the case of the boom raising. Further, the speed fluctuation at times of load inversion can be suppressed. Here, similarly to the explanation of the boom raising operation, an explanation will be given of an example in which the delivery flow rate from the open circuit hydraulic pump 1*a* is controlled to be equal to the difference between the head-side chamber flow rate and the rod-side chamber flow rate.

The two-dot chain lines in FIG. 5 indicate time points at which the load direction of the arm cylinder 7*a* inverts in the arm crowding and in the arm dumping. In the state in the first half of the arm crowding (before the load direction inversion) in which the arm has been extended, the rod-side chamber is on the high pressure side since the arm weight works in the direction of pulling the cylinder. In the state in the latter half of the arm crowding (after the load direction inversion) in which the arm has been folded, the head-side chamber is on the high pressure side since the arm weight works reversely in the direction of pushing the cylinder. Suppose the confluence assist by the open circuit hydraulic pump 1*a* is absent, the cylinder speed fluctuates significantly at the time of load direction inversion as indicated by the chain line in FIG. 5 and the charge flow becomes necessary depending on the cylinder speed. Specifically, the cylinder speed in the first half of the arm crowding (which is determined by the pressure-receiving area Ar of the rod-side chamber and the outward flow rate (=Qcp1) from the rod-side chamber) equals Qcp1/Ar, whereas the cylinder speed in the latter half of the arm crowding (which is determined by the pressure-receiving area Ah of the head-side chamber and the inward flow rate (=Qcp1) into the head-side chamber) equals Qcp1/Ah. When a cylinder satisfying Ah:Ar=5:3 is used, for example, the cylinder speed drops by as much as 40% at the time of load direction inversion in the arm crowding, which significantly deteriorates the operability.

In contrast, when the confluence assist by the open circuit hydraulic pump 1*a* is present as in this embodiment, although the cylinder speed in the first half of the arm crowding equals that (Qcp1/Ar) of the case without the confluence assist, the cylinder speed in the latter half of the arm crowding is (Qcp1+Qop1)/Ah since the head-side chamber is supplied with the delivery flows from both the closed circuit hydraulic pump 2*a* and the open circuit hydraulic pump 1*a*. By substituting the aforementioned expression (3) into (Qcp1+Qop1)/Ah, the cylinder speed in the latter half of the arm crowding is calculated as Qcp1/Ar. Since the cylinder speeds before and after the load direction inversion are equal to each other (=Qcp1/Ar), the speed fluctuation at the time of load direction inversion can be suppressed almost perfectly.

Incidentally, while the above explanation has been given of the example in which the delivery flow rate from the open circuit hydraulic pump 1*a* is controlled to be equal to the difference between the head-side chamber flow rate and the rod-side chamber flow rate, this embodiment is effective also when the flow rate from the open circuit hydraulic pump 1*a* is controlled to be slightly higher or lower than the difference. Suppose the flow rate of the closed circuit hydraulic pump 2*a* is set at Qcp1 in the same way as the above explanation and the flow rate of the open circuit hydraulic pump 1*a* is controlled to be slightly higher than the aforementioned value Qop1, the cylinder speed in the first half of the arm crowding equals the value V1 (=Qcp1/Ar) in the above explanation. In the latter half of the arm crowding, the cylinder speed increases from the speed V1 in the first half only slightly corresponding to the increment in the flow rate of the open circuit hydraulic pump 1*a*. Since surplus assist flow escapes to the low-pressure line via the flushing valve 6*a*, no hydraulic circuit failure is caused and the charge flow rate from the charge circuit is allowed to be 0 also in this case. On the other hand, suppose the flow rate from the open circuit hydraulic pump 1*a* is controlled to be slightly lower than the aforementioned value Qop1, the cylinder speed in the first half of the arm crowding equals the aforementioned value V1 (=Qcp1/Ar). In the latter half of the arm crowding, the cylinder speed decreases from the speed V1 in the first half only slightly corresponding to the decrement in the flow rate of the open circuit hydraulic pump 1*a*. While a charge flow corresponding to the insufficiency of the assist flow is supplied via the flushing valve 6*a*, the charge flow rate is allowed to be far lower than that of the case with no assist and no hydraulic circuit failure occurs also in this case. However, in order to suppress the speed fluctuation at times of load inversion, it goes without saying that it is desirable to control the delivery flow rate from the open circuit hydraulic pump 1*a* as closer to the difference (between the head-side chamber flow rate and the rod-side chamber flow rate) as possible.

———Arm Dumping———

In the arm dumping (low speed and high speed), concurrently with the arm lever operation, the switching valve 12*a* is opened (ON), the proportional control valve 14*a* is controlled in the opening direction (ON), only the closed circuit hydraulic pump 2*a* is driven (ON) (single operation 6 in FIG. 3), and a flow −Qcp1 or −Qcp2 of the hydraulic fluid corresponding to the arm lever operation amount is sent from the hydraulic pump 2*a* to the rod-side chamber of the arm cylinder 7*a* while the hydraulic fluid in the head-side chamber is discharged to the hydraulic fluid tank 9 via the proportional control valve 14*a* (discharge assist). In this case, the controller 41 performs the control so that the discharge flow rate from the proportional control valve 14*a* is determined based on the difference between the head-side chamber flow rate and the rod-side chamber flow rate of the arm cylinder 7*a*. Here, similarly to the explanation of the arm crowding operation, an explanation will be given of an example in which the discharge flow rate from the proportional control valve 14*a* is controlled to be equal to the difference between the head-side chamber flow rate and the rod-side chamber flow rate. Specifically, assuming that the discharge flow rate of the proportional control valve 14*a* is Qpv1 or Qpv2 (similarly to the example of controlling the delivery flow rate of the open circuit hydraulic pump at the time of cylinder extension (expression (3)), the control is performed to satisfy:

$$Qpv1=Qcp1\times(Ah/Ar-1) \tag{4}$$

or $$Qpv2=Qcp2\times(Ah/Ar-1) \tag{5}$$

By this control, the cylinder speed can be increased compared to the case where the arm cylinder 7*a* is driven by the closed circuit hydraulic pump 2*a* alone, while also suppressing the speed fluctuation at times of load direction inversion. Suppose the discharge assist by the proportional control valve 14*a* is absent, the cylinder speed fluctuates significantly around the load direction inversion as indicated by the broken line in FIG. 5 and deteriorates the operability.

Incidentally, employing a flow control valve having the pressure compensation function as the proportional control valve 14*a* makes it possible to easily control the discharge flow rate of the proportional control valve at the target flow rate even when the pressure of the cylinder fluctuates significantly, by which stable and excellent operability can be achieved in a wide range of operating conditions.

While the above explanation has been given of the example in which the discharge flow rate from the proportional control valve 14*a* is controlled to be equal to the difference between the head-side chamber flow rate and the rod-side chamber flow rate, this embodiment is effective also when the flow rate from the proportional control valve 14*a* is controlled to be slightly higher or lower than the difference. Taking the arm dumping (high speed) as an example, suppose the flow rate of the closed circuit hydraulic pump 2*a* is set at −Qcp1 in the same way as the above explanation and the flow rate of the proportional control valve 14*a* is controlled to be slightly higher than the aforementioned value −Qpv1, the cylinder speed in the first half of the arm dumping just slightly increases from the value −V1 in the above explanation and the cylinder speed in the latter half of the arm dumping equals the value −V1 (=−Qcp1/Ar) in the above explanation. Further, no hydraulic circuit failure occurs since a charge flow corresponding to the amount of the hydraulic fluid excessively released from the closed circuit to the tank is supplied via the flushing valve 6*a*. On the other hand, suppose the flow rate from the proportional control valve 14*a* is controlled to be slightly lower than the aforementioned value −Qpv1, the cylinder speed in the first half of the arm dumping just slightly decreases from the value −V1 in the above explanation and the cylinder speed in the latter half of the arm dumping equals the value −V1 in the above explanation. No hydraulic circuit failure occurs also in this case since surplus hydraulic fluid in the closed circuit escapes to the low-pressure line via the flushing valve 6*a*. However, in order to suppress the speed fluctuation at times of load inversion, it goes without saying that it is desirable to control the discharge flow rate from the proportional control valve 14*a* as closer to the difference (between the head-side chamber flow rate and the rod-side chamber flow rate) as possible.

Figure 6C:
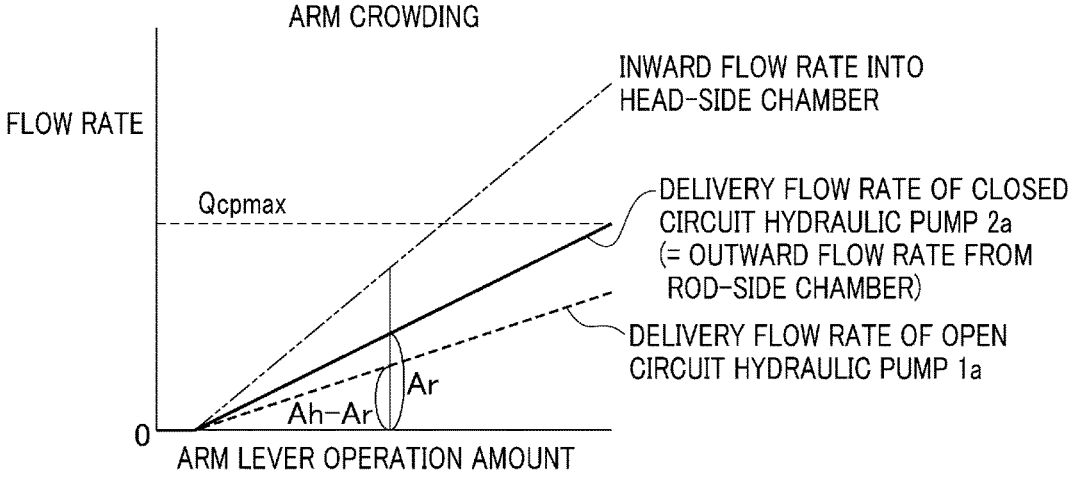
FIG. 6C is a graph showing the relationship between an arm lever operation amount in arm crowding and a pump flow rate, etc. in the hydraulic excavator equipped with the hydraulic system for a work machine in accordance with the first embodiment.
Figure 6D:
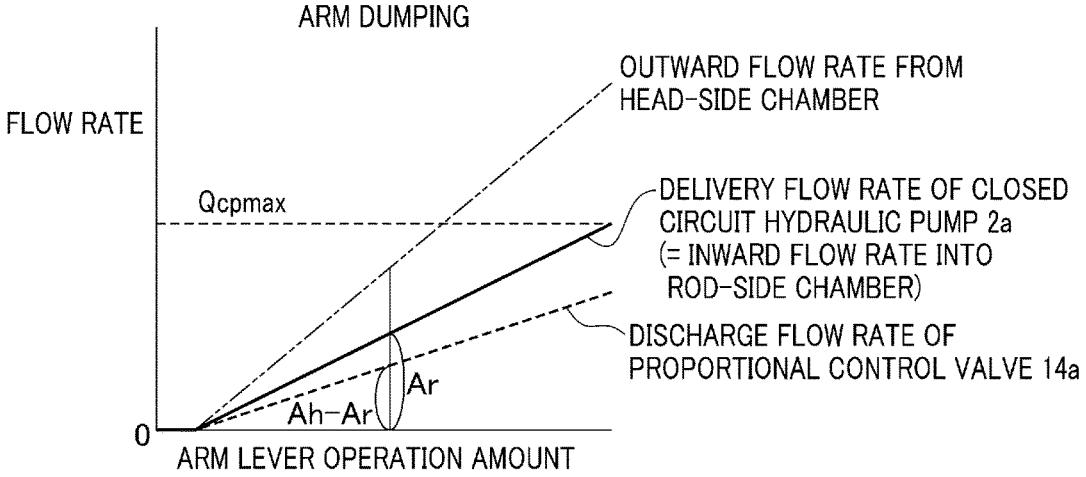
FIG. 6D is a graph showing the relationship between the arm lever operation amount in arm dumping and a pump flow rate, etc. in the hydraulic excavator equipped with the hydraulic system for a work machine in accordance with the first embodiment.

FIG. 6C shows the relationship between the arm lever operation amount in the arm crowding and the delivery flow rates of the hydraulic pumps 1*a* and 2*a*. FIG. 6D shows the relationship between the arm lever operation amount in the arm dumping, the delivery flow rates of the hydraulic pumps 1*a* and 2*a*, and the discharge flow rate of the proportional control valve 14*a*. The relationship in the boom raising shown in FIG. 6A and the relationship in the arm crowding shown in FIG. 6C are equivalent to each other. In the boom lowering shown in FIG. 6B, when the boom lever operation amount is small (low-speed driving), the boom cylinder is driven by the closed circuit hydraulic pump 2*b* alone and the power regeneration is conducted to the fullest extent. In the case of the arm, however, cylinder positions where the regeneration is possible are limited to the first half of the arm dumping and the first half of the arm crowding and the regenerated energy itself is also low. Therefore, the discharge flow rate of the proportional control valve 14*a* is increased proportionally to the arm lever operation amount from low-speed driving as shown in FIG. 6D (simplified control compared to the control in the boom lowering shown in FIG. 6B).

——Combined Operation of Swinging and Boom Raising——

Next, combined operation of swinging and boom raising, as the most typical combined operation, will be explained below by referring to FIGS. 1 and 3. As shown in FIG. 3, the operation of the hydraulic pumps and the switching valves in the swinging and boom raising (combined operation a) is substantially equivalent to that in the boom raising (single operation 1) except that the driving of the hydraulic pump 1*a* (ON) is added. The boom raising operation in this example is performed by merging together the delivery flows from the open circuit hydraulic pump 1*b* and the closed circuit hydraulic pump 2*b* in the same way as in the single operation 1. The swinging operation is performed by supplying the delivery flow of the open circuit hydraulic pump 1*a* to the swing hydraulic motor 10*c* (FIG. 1) via the swing spool valve 11*a* (FIG. 1). Since the open circuit hydraulic pump 1*b* for performing the confluence assist on the boom cylinder 7*b* is provided separately from the open circuit hydraulic pump 1*a* for driving the swing hydraulic motor 10*c* in the hydraulic system of this embodiment, it becomes possible to send the hydraulic fluid from the open circuit hydraulic pump 1*b* to the head-side chamber of the boom cylinder 7*b* (confluence assist) even in the combined operation of swinging and boom raising (frequently performed on the hydraulic excavator). This allows to reduce the charge flow rate from the charge circuit 105 to a minute level. Further, since the swing operation and the boom operation are performed by use of separate hydraulic pumps, the matching between the swinging speed and the boom raising speed becomes easier. In the hydraulic excavator, the swinging speed and the boom raising speed are generally required to be within their respective appropriate ranges (matched) when the swinging and the boom raising are performed at the same time with the full lever operations. For example, if the swinging is too fast (ends too early), the bucket position has to be adjusted even after the end of the swinging by continuing the boom raising only, which deteriorates the working efficiency of the excavator. Ordinary hydraulic excavators (controlling all the actuators with control valves) need an extremely long time for this matching. In the hydraulic system of this embodiment in which the hydraulic circuit for driving the boom cylinder 7*b* and the hydraulic circuit for driving the swing hydraulic motor are perfectly independent of each other, the boom raising speed and the swinging speed can be adjusted independently of each other and the matching can be completed in a short period.

——Effects——

As explained above, the following effects are achieved by the hydraulic system according to this embodiment:

(1) The charge flow rate from the charge circuit 105 can be reduced to an extremely low level by performing the confluence assist by the open circuit hydraulic pump 1*b* or 1*a* at times of extension of the boom cylinder 7*b* or the arm cylinder 7*a*. Therefore, the charge circuit 105 (charge system) including the charge pump 5 can be miniaturized and the energy saving performance and the mountability can be improved.

(2) By performing the confluence assist by the open circuit hydraulic pump 1*b* or 1*a* at times of extension of the boom cylinder 7*b* or the arm cylinder 7*a*, the cylinder speed fluctuation at times of load direction inversion can be suppressed, shocks and vibrations can be reduced, and excellent operability can be achieved.

(3) Since the self-priming performance of the open circuit hydraulic pump 1*a* or 1*b* is high, the occurrence of cavitation can be suppressed even at times of confluence assist in high-speed extension.

(4) By performing the discharge assist by the proportional control valve 14*b* or 14*b* at times of retraction of the boom cylinder 7*b* or the arm cylinder 7*a*, the cylinder speed can be increased and the operating speed can be increased without the need of increasing the displacement (capacity) of the closed circuit hydraulic pump 2*a* or 2*b*. Further, since the cylinder speed fluctuation at times of load direction inversion can be suppressed, shocks and vibrations can be reduced and excellent operability can be achieved.

(5) By employing a flow control valve having the pressure compensation function as the proportional control valve 14*b* or 14*a*, it becomes possible to easily control the discharge flow rate of the proportional control valve at the target flow rate even when the head-side pressure of the cylinder fluctuates at the time of cylinder retraction. Consequently, excellent operability can be achieved.

(6) By discharging the hydraulic fluid from the proportional control valve 14*b* or 14*a* to the hydraulic fluid tank 9 at times of retraction of the boom cylinder 7*b* or the arm cylinder 7*a*, the runaway (over-rev) of the engine 20 at the time of regeneration can be prevented and energy regeneration to the fullest extent can be conducted stably.

(7) By providing the open circuit hydraulic pump 1*b* (for performing the confluence assist on the boom cylinder 7*b*) separately from the open circuit hydraulic pump 1*a* (for driving the swing hydraulic motor 10*c*), the confluence assist to the boom cylinder 7*b* becomes possible even in the combined operation of swinging and boom raising. Also in this regard, the charge flow rate from the charge circuit 105 can be suppressed, by which the charge circuit 105 (charge system) can be miniaturized and the energy saving performance and the mountability can be improved. Further, since the swing motor and the boom cylinder are driven by separate hydraulic pumps, the matching between the swinging and the boom raising becomes easier.

Second Embodiment

—Configuration—

Figure 7:
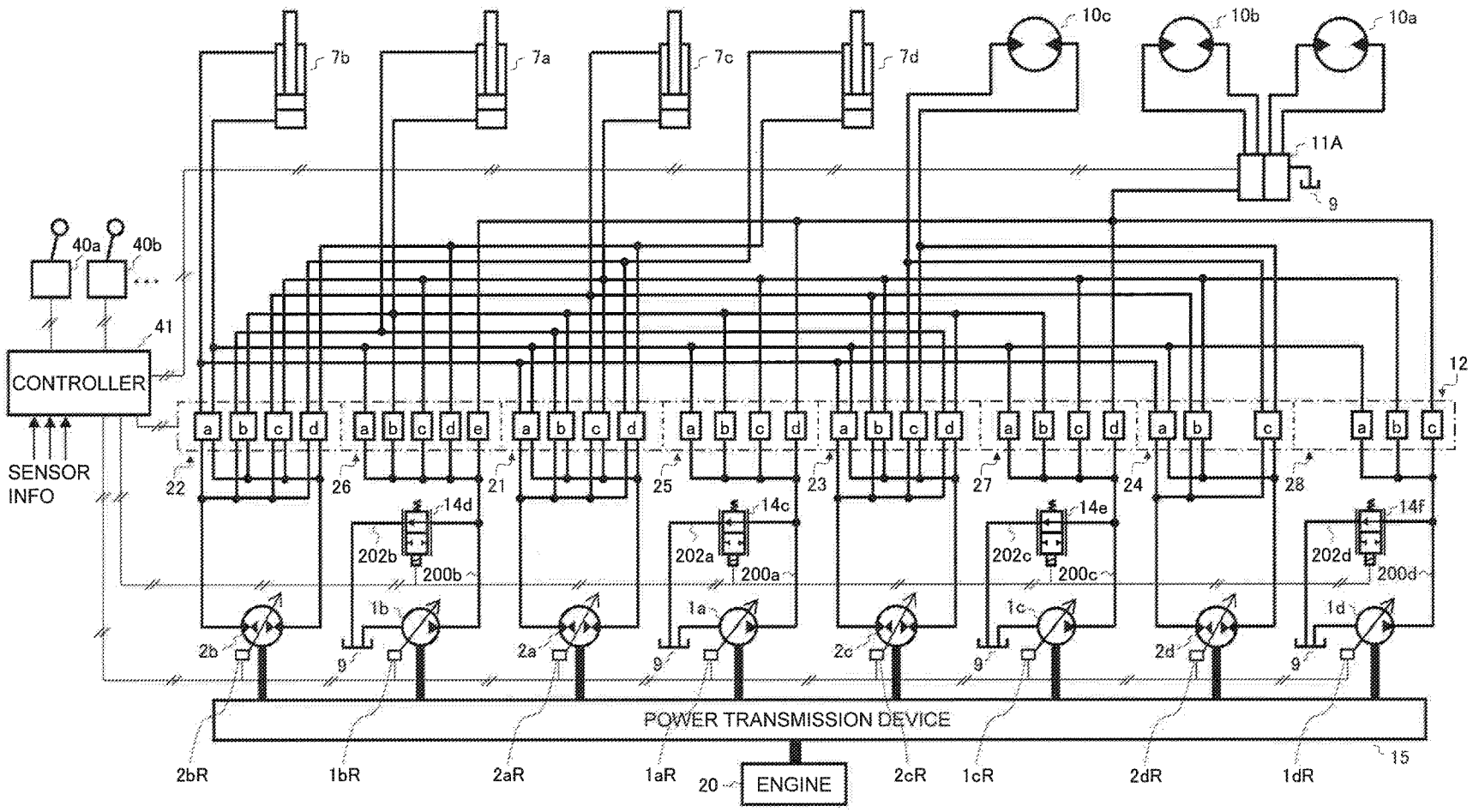
FIG. 7 is a hydraulic circuit diagram of a hydraulic system for a work machine in accordance with a second embodiment of the present invention.

FIG. 7 is a schematic diagram showing the overall configuration of a hydraulic system in accordance with a second embodiment of the present invention. FIG. 7 shows an example in which the hydraulic system is installed in a large-sized hydraulic excavator. Components in FIG. 7 equivalent to those in FIG. 1 are assigned the same reference characters as in FIG. 1.

In FIG. 7, the hydraulic system in this embodiment comprises four closed circuit hydraulic pumps 2*a*-2*d*, four open circuit hydraulic pumps 1*a*-1*d*, and a plurality of actuators such as single rod hydraulic cylinders (arm cylinder 7*a*, boom cylinder 7*b*, bucket cylinder 7*c*, dump cylinder 7*d*) and hydraulic motors (right travel hydraulic motor 10*a*, left travel hydraulic motor 10*b*, swing hydraulic motor 10*c*). Each closed circuit hydraulic pump 2*a*, 2*b*, 2*c*, 2*d* includes a regulator 2*a*R, 2*b*R, 2*c*R, 2*d*R. Each open circuit hydraulic pump 1*a*, 1*b*, 1*c*, 1*d* includes a regulator 1*a*R, 1*b*R, 1*c*R, 1*d*R.

An engine 20 drives the four open circuit hydraulic pumps 1*a*-1*d*, the four closed circuit hydraulic pumps 2*a*-2*d*, and a charge pump (unshown in FIG. 7) via a power transmission device 15.

The four closed circuit hydraulic pumps 2*a*-2*d* and the four open circuit hydraulic pumps 1*a*-1*d* are respectively connected to corresponding hydraulic actuators via corresponding normally-closed switching valves (on-off valves) of an on-off valve unit 12.

More specifically, the closed circuit hydraulic pump 2*a* is connected to the boom cylinder 7*b*, the arm cylinder 7*a*, the bucket cylinder 7*c* and the dump cylinder 7*d* via switching valves 21*a*-21*d* (second switching valves). The closed circuit hydraulic pump 2*b* is connected to the boom cylinder 7*b*, the arm cylinder 7*a*, the bucket cylinder 7*c* and the dump cylinder 7*d* via switching valves 22*a*-22*d* (second switching valves). The closed circuit hydraulic pump 2*c* is connected to the boom cylinder 7*b*, the bucket cylinder 7*c*, the swing hydraulic motor 10*c* and the arm cylinder 7*a* via switching valves 23*a*-23*d* (second switching valves). The closed circuit hydraulic pump 2*d* is connected to the boom cylinder 7*b*, the bucket cylinder 7*c* and the swing hydraulic motor 10*c* via switching valves 24*a*-23*c* (second switching valves). As above, the boom cylinder 7*b* is configured to be capable of closed circuit connection with the closed circuit hydraulic pumps 2*a*-2*d*, the arm cylinder 7*a* is configured to be capable of closed circuit connection with the closed circuit hydraulic pumps 2*a*-2*c*, the bucket cylinder 7*c* is configured to be capable of closed circuit connection with the closed circuit hydraulic pumps 2*a*-2*d*, the dump cylinder 7*d* is configured to be capable of closed circuit connection with the closed circuit hydraulic pumps 2*a*-2*c*, and the swing hydraulic motor 10*c* is configured to be capable of closed circuit connection with the closed circuit hydraulic pumps 2*c* and 2*d*.

The open circuit hydraulic pump 1*a* is connected to the head-side chambers of the boom cylinder 7*b*, the arm cylinder 7*a* and the bucket cylinder 7*c* via switching valves 25*a*-25*c* (first switching valves), and to a control valve 11A via a switching valve 25*d* (third switching valve). The open circuit hydraulic pump 1*b* is connected to the head-side chambers of the boom cylinder 7*b*, the arm cylinder 7*a*, the bucket cylinder 7*c* and the dump cylinder 7*d* via switching valves 26*a*-26*d* (first switching valves), and to the control valve 11A via a switching valve 26*e* (third switching valve). The open circuit hydraulic pump 1*c* is connected to the head-side chambers of the boom cylinder 7*b*, the arm cylinder 7*a* and the bucket cylinder 7*c* via switching valves 27*a*-27*c* (first switching valves), and to the control valve 11A via a switching valve 27*d* (third switching valve). The open circuit hydraulic pump 1*d* is connected to the head-side chambers of the boom cylinder 7*b* and the bucket cylinder 7*c* via switching valves 28*a* and 28*b* (first switching valves), and to the control valve 11A via a switching valve 28*c* (third switching valve). The hydraulic circuit including the switching valves 25*a*-25*c*, the switching valves 26*a*-26*d*, the switching valves 27*a*-27*c* and the switching valves 28*a* and 28*b* constitutes an assist circuit for supplementing the head-side chambers of the boom cylinder 7*b*, the arm cylinder 7*a*, the bucket cylinder 7*c* and the dump cylinder 7*d* with the hydraulic fluid. This configuration allows the head-side chamber of the boom cylinder 7*b* to be supplemented with the hydraulic fluid from the open circuit hydraulic pumps 1*a*-1*d*, the head-side chamber of the arm cylinder 7*a* to be supplemented with the hydraulic fluid from the open circuit hydraulic pumps 1*a*-1*c*, the head-side chamber of the bucket cylinder 7*c* to be supplemented with the hydraulic fluid from the open circuit hydraulic pumps 1*a*-1*d*, and the head-side chamber of the dump cylinder 7*d* to be supplemented with the hydraulic fluid from the open circuit hydraulic pump 1*b*.

As above, the hydraulic system in this embodiment is configured so that the boom cylinder 7*b* needing a high flow rate is connectable with all the eight hydraulic pumps 1*a*-1*d* and 2*a*-2*d* and the swing hydraulic motor 10*c* needing only a low flow rate is connectable with the two hydraulic pumps 2*c* and 2*d* only.

Further, proportional control valves 14*c*-14*f* are arranged in hydraulic fluid return lines 202*a*-202*d* branching out from hydraulic fluid supply lines 200*a*-200*d* of the open circuit hydraulic pumps 1*a*-1*d* (hydraulic lines between the hydraulic fluid tank 9 and the head-side chambers of the boom cylinder 7*b*, the arm cylinder 7*a*, the bucket cylinder 7*c* and the dump cylinder 7*d*). This configuration allows the control valves 14*c*-14*f* to discharge the hydraulic fluid from the head-side chambers of the boom cylinder 7*b*, the arm cylinder 7*a*, the bucket cylinder 7*c* and the dump cylinder 7*d* to the hydraulic fluid tank 9.

The control valve 11A is connected to the right travel hydraulic motor 10*a* and the left travel hydraulic motor 10*b* so that the hydraulic fluid from the open circuit hydraulic pumps 1*a*-1*d* can be supplied to the right travel hydraulic motor 10*a* and the left travel hydraulic motor 10*b* via the control valve 11A.

Similarly to the first embodiment shown in FIG. 1, the hydraulic lines connected to the head-side chambers and the rod-side chambers of the boom cylinder 7*b*, the arm cylinder 7*a*, the bucket cylinder 7*c* and the dump cylinder 7*d* are provided with the flushing valves, the check valves for supply and the relief valves (unshown in FIG. 7).

While the proportional control valves 14*c*-14*f* in the above explanation of this embodiment are arranged in the hydraulic fluid return lines 202*a*-202*d* branching out from the hydraulic fluid supply lines 200*a*-200*d* of the open circuit hydraulic pumps 1*a*-1*d*, it is also possible to provide hydraulic fluid return lines branching out from the hydraulic lines connected to the head-side chambers of the hydraulic cylinders 7*a*-7*d* and directly reaching the hydraulic fluid tank 9 and to arrange the proportional control valves 14*c*-14*f* in the hydraulic fluid return lines.

—Operation—

The operation of each actuator in the hydraulic system configured as above will be explained below by referring to FIG. 7.

——Boom Raising——

When performing the boom raising at a low speed, the switching valves 22*a* and 26*a* are opened, for example, and the closed circuit hydraulic pump 2*b* and the open circuit hydraulic pump 1*b* are driven, by which a flow corresponding to the boom lever operation amount is sent to the head-side chamber of the boom cylinder 7*b* from both the closed circuit hydraulic pump 2*b* and the open circuit hydraulic pump 1*b*. In this case, similarly to the first embodiment, the controller 41 controls the delivery flow rate of the open circuit hydraulic pump 1*b* so that the flow rate of the hydraulic fluid sent from the open circuit hydraulic pump 1*b* to the head-side chamber of the boom cylinder 7*b* is determined based on the difference between the head-side chamber flow rate and the rod-side chamber flow rate which is caused by the pressure-receiving area difference between the head-side chamber and the rod-side chamber of the boom cylinder 7*b*. When performing the boom raising at a high speed, the number of utilized hydraulic pumps is increased and the hydraulic fluid is sent to the head-side chamber of the boom cylinder 7*b* from eight hydraulic pumps at the maximum. Also in this case of increasing the number of utilized hydraulic pumps, the delivery flow rate of each hydraulic pump is controlled so that the total delivery flow rate of the open circuit hydraulic pumps is determined based on the difference between the head-side chamber flow rate and the rod-side chamber flow rate of the boom cylinder 7*b*.

With the above operation, the charge flow rate from the charge circuit (unshown) can be reduced to substantially 0, by which the charge system can be miniaturized and the energy saving performance and the mountability can be improved. The flow rate necessary for driving the boom cylinder 7*b* is incommensurably high especially in large-sized hydraulic excavators, and thus the necessary charge flow rate amounts to the order of 1000 L/min at the maximum in cases where the confluence assist by the open circuit hydraulic pumps 1*a*-1*d* is not performed. Therefore, the effects of the present invention on the energy saving performance and the mountability are remarkable. Further, since the maximum delivery flow rate per hydraulic pump is high (on the order of 500 L/min) in such large-sized hydraulic excavators, it is extremely difficult for a closed circuit hydraulic pump having a small suction port to suck in such a high flow from the hydraulic fluid tank 9, and consequently, the cavitation occurs. In this embodiment, the confluence assist is performed by sucking in the hydraulic fluid from the hydraulic fluid tank 9 by use of the open circuit hydraulic pumps 1*a*-1*d* having high self-priming performance, by which stable suction performance can be achieved even at such a high flow rate.

Incidentally, when performing the boom raising at an extremely low speed, the necessary charge flow rate is low in principle, and thus the boom cylinder 7*b* may be driven by only one closed circuit hydraulic pump without the confluence assist by an open circuit hydraulic pump.

By reducing the number of utilized hydraulic pumps to one (one closed circuit hydraulic pump) or two (one closed circuit hydraulic pump and one open circuit hydraulic pump) at times of low speed (needing only a low flow rate) as above, each hydraulic pump can be used in the region in which the pump efficiency is high, by which the energy saving performance increases further. In the case of a variable displacement swash plate piston pump (commonly used type), high pump efficiency of approximately 90% can be achieved when the pump displacement is around the maximum pump displacement. However, the pump efficiency drops to approximately 60% when the pump displacement is around 20% of the maximum pump displacement. Therefore, reducing the number of utilized hydraulic pumps to the minimum and using the hydraulic pump(s) in a region where the pump displacement is large (even though the flow rate to be achieved is the same) is effective in terms of energy saving.

——Boom Lowering——

When performing the boom lowering at a low speed, one of the switching valves 21*a*-24*a* (e.g., the switching valve 22*a*) is opened, for example, and the closed circuit hydraulic pump 2*b* is driven, by which a flow corresponding to the boom lever operation amount is sent from the closed circuit hydraulic pump 2*b* to the rod-side chamber of the boom cylinder 7*b*. When increasing the speed of boom lowering, the number of utilized closed circuit hydraulic pumps is increased according to the speed and the four closed circuit hydraulic pumps 2*a*-2*d* are used at the maximum. When a boom lowering speed beyond the maximum flow rate of the four closed circuit hydraulic pumps is necessary, the switching valve 26*a* and the proportional control valve 14*d* are opened, for example, and a flow corresponding to the boom lever operation amount is discharged from the head-side chamber of the boom cylinder 7*b* and returned to the hydraulic fluid tank 9 via the hydraulic fluid tank 9 (discharge assist) similarly to the first embodiment. When further increasing the boom lowering speed, the number of utilized proportional control valves is increased and the flow is returned from the head-side chamber of the boom cylinder 7*b* to the hydraulic fluid tank 9 by opening the four proportional control valves 14*c*-14*f* at the maximum. Consequently, the operating speed of the hydraulic excavator increases.

Similarly to the first embodiment, in cases where the regenerated energy in the boom lowering operation cannot be absorbed by the decrease in the fuel injection quantity of the engine alone, the discharge assist is performed by opening a switching valve and a proportional control valve even if the necessary flow rate is within the maximum flow rate of the four closed circuit hydraulic pumps, by which the runaway of the engine can be prevented while securing a necessary cylinder speed.

——Arm Crowding——

When performing the arm crowding, similarly to the case of the boom raising, one or more of the switching valves 21*b*-24*b* are opened, one or more of the switching valves 25*b*-27*b* are opened, and one or more of the closed circuit hydraulic pumps 2*a*-2*d* and one or more of the open circuit hydraulic pumps 1*a*-1*c* are driven, by which a flow corresponding to the arm lever operation amount is sent to the head-side chamber of the arm cylinder 7*a* from both the closed circuit hydraulic pump(s) and the open circuit hydraulic pump(s). In this case, similarly to the first embodiment, the controller 41 controls the delivery flow rate of the open circuit hydraulic pump(s) so that the flow rate of the hydraulic fluid sent from the open circuit hydraulic pump(s) to the head-side chamber of the arm cylinder 7*a* is determined based on the difference between the head-side chamber flow rate and the rod-side chamber flow rate which is caused by the pressure-receiving area difference between the head-side chamber and the rod-side chamber of the arm cylinder 7*a*. Accordingly, the arm cylinder 7*a* expands at a speed V1 corresponding to the arm lever operation amount X1 and the charge flow rate from the charge circuit can be kept at 0 similarly to the case of the boom raising. Further, the speed fluctuation at times of load inversion can be suppressed.

——Arm Dumping——

When performing the arm dumping, similarly to the case of the boom lowering, one or more of the switching valves 21*b*-24*b* are opened and one or more of the closed circuit hydraulic pumps 2*a*-2*d* are driven, by which a flow corresponding to the arm lever operation amount is sent from the closed circuit hydraulic pump(s) to the rod-side chamber of the arm cylinder 7*a*. When an arm dumping speed beyond the maximum flow rate of the four closed circuit hydraulic pumps is necessary, one or more of the switching valve 25*b*-27*b* and one or more of the proportional control valves 14*c*-14*e* are opened and a flow corresponding to the arm lever operation amount is discharged from the head-side chamber of the arm cylinder 7*a* and returned to the hydraulic fluid tank 9 via the proportional control valve(s) (discharge assist) similarly to the first embodiment. Accordingly, the speed fluctuation at times of load direction inversion can be suppressed and the operability can be improved while increasing the cylinder speed.

——Other Examples——

When performing the combined operation of boom raising and arm crowding, the number of hydraulic pumps supplying the hydraulic fluid to the boom cylinder 7*b* and the arm cylinder 7*a* is changed according to the necessary speeds (necessary flow rates) of the boom cylinder 7*b* and the arm cylinder 7*a*. For example, when the boom and the arm are operated at high speeds with equivalent flow rates, four hydraulic pumps (two closed circuit hydraulic pumps and two open circuit hydraulic pumps) are used for each of the boom cylinder 7*b* and the arm cylinder 7*a*. When the boom is operated at a high speed and the arm is operated at a low speed, six hydraulic pumps (three closed circuit hydraulic pumps and three open circuit hydraulic pumps) are used for the boom cylinder 7*b* and two hydraulic pumps (one closed circuit hydraulic pump and one open circuit hydraulic pump) are used for the arm cylinder 7*a*. By performing the confluence assist by the open circuit hydraulic pump(s) on each of the boom cylinder 7*b* and the arm cylinder 7*a* while changing the number of utilized hydraulic pump sets (each made of a closed circuit hydraulic pump and an open circuit hydraulic pump) as above, the charge flow rate from the charge circuit can be kept at substantially 0 even at times of the combined operation.

Further, since there are four sets of hydraulic pumps in this embodiment, the combined operation is possible up to the four hydraulic cylinders of the boom, arm, bucket and dump and the charge flow rate from the charge circuit can be kept at substantially 0 even at times of the quadruple combined operation of the boom, arm, bucket and dump.

Furthermore, since the hydraulic system is equipped with the proportional control valves 14*c*-14*f*, the speed fluctuation at times of load direction inversion can be suppressed in both directions (extension, retraction) in all the four hydraulic cylinders, by which excellent operability can be achieved in both the single operations and the combined operations.

When performing the swing operation, the switching valves 23*c* and 24*c* are opened and the hydraulic fluid is supplied to the swing hydraulic motor 10*c* from one or both of the closed circuit hydraulic pumps 2*c* and 2*d*. The swing hydraulic motor 10*c* is configured to use only the closed circuit hydraulic pumps 2*c* and 2*d* since the swing hydraulic motor 10*c* does not cause the flow rate difference dependent on the rotation direction differently from the hydraulic cylinders.

When performing the traveling operation, one or more of the switching valve 25*d*, 26*e*, 27*d* and 28*c* are opened and open circuit driving by the control valve 11A is performed by using one or more of the open circuit hydraulic pumps 1*a*-1*d*. Since the travel hydraulic motors 10*a* and 10*b* are of low frequencies of use, the operability in the combined operation is improved by employing the open circuit driving by the control valve 11A.

Incidentally, while an example of a hydraulic system equipped with eight hydraulic pumps has been described in this embodiment, the configuration of the hydraulic closed circuit connection may be added also to the right and left travel hydraulic motors 10*a* and 10*b* in cases where the number of hydraulic pumps can be increased further. In cases where the number of installable hydraulic pumps is less than eight, it is possible to configure only hydraulic cylinders needing strong driving force (e.g., the boom cylinder 7*b* and the arm cylinder 7*a*) in the hydraulic closed circuit connection and configure the other actuators in the hydraulic open circuit connection employing the control valve as explained in the first embodiment (FIG. 1).

—Effects—

Effects similar to those of the first embodiment can be achieved also by this embodiment configured as above.

Further, the following effects are achieved by this embodiment:

(1) Since the confluence assist to one hydraulic actuator by multiple hydraulic pumps becomes possible in this embodiment, the necessary actuator speed can be secured while also reducing the displacement per hydraulic pump especially when the hydraulic system is employed for a large-sized hydraulic excavator.

(2) Further, by adjusting the number of hydraulic pumps performing the confluence assist according to the actuator speed, the hydraulic pumps can be used in regions where the pump efficiency is high, by which the energy saving performance of the work machine can be improved.

DESCRIPTION OF REFERENCE CHARACTERS

1*a*-1*d* open circuit hydraulic pump
2*a*-2*d* closed circuit hydraulic pump
4*a*-4*e* relief valve

5 charge pump
6*a*, 6*b* flushing valve
7*a* arm cylinder
7*b* boom cylinder
7*c* bucket cylinder
7*d* dump cylinder
9 hydraulic fluid tank
10*a* right travel hydraulic motor
10*b* left travel hydraulic motor
10*c* swing hydraulic motor
11 control valve
11*a*-11*e* spool valve
12*a*-12*b* switching valve (first switching valve)
13 confluence valve
14*a*, 14*b* proportional control valve
14*c*-14*f* proportional control valve
15 power transmission device
16 high-pressure relief valve
20 engine
21*a*-21*d* switching valve (second switching valve)
22*a*-22*d* switching valve (second switching valve)
23*a*-23*d* switching valve (second switching valve)
24*a*-24*c* switching valve (second switching valve)
25*a*-25*c* switching valve (first switching valve)
25*d* switching valve (third switching valve)
26*a*-26*d* switching valve (first switching valve)
26*e* switching valve (third switching valve)
27*a*-27*c* switching valve (first switching valve)
27*d* switching valve (third switching valve)
28*a*, 28*b* switching valve (first switching valve)
28*c* switching valve (third switching valve)
40*a*-40*d* operation device
41 controller
100, 101 hydraulic closed circuit
100*a*, 101*a* first hydraulic line
100*b*, 101*b* second hydraulic line
105 charge circuit
200, 201 hydraulic open circuit
200*a*, 201*a* hydraulic fluid supply line
200*b*, 201*b* hydraulic fluid return line
300*a*, 301*a* hydraulic line

The invention claimed is:

1. A hydraulic system for a work machine equipped with at least one closed circuit hydraulic pump having two delivery ports and being capable of bidirectional delivery and at least one single rod hydraulic cylinder having a head-side chamber and a rod-side chamber to which the two delivery ports of the closed circuit hydraulic pump are connected, respectively, comprising:

at least one open circuit hydraulic pump having a suction port for sucking in hydraulic fluid from a hydraulic fluid tank and a delivery port for delivering the hydraulic fluid;

a first switching valve which is arranged between the head-side chamber of the hydraulic cylinder and the delivery port of the open circuit hydraulic pump;

a proportional control valve which is arranged between the head-side chamber of the hydraulic cylinder and the hydraulic fluid tank; and a control unit operable to:

control the closed circuit hydraulic pump, the open circuit hydraulic pump and the first switching valve at times of extension of the hydraulic cylinder so that a delivery flow is sent to the head-side chamber of the hydraulic cylinder from both the closed circuit hydraulic pump and the open circuit hydraulic pump, and control the closed circuit hydraulic pump and the proportional control valve at times of retraction of the hydraulic cylinder so that part of an outward flow from the head-side chamber of the hydraulic cylinder is returned to the closed circuit hydraulic pump and an other part of the outward flow from the head-side chamber of the hydraulic cylinder is returned to the hydraulic fluid tank, wherein:

the proportional control valve is arranged in a hydraulic line that connects the delivery port of the open circuit hydraulic pump to the hydraulic fluid tank, and the control unit switches the first switching valve to its open position and controls the proportional control valve at its closed position at times of extension of the hydraulic cylinder, and the control unit switches the first switching valve to its open position and controls the proportional control valve at its open position at times of retraction of the hydraulic cylinder, wherein the hydraulic system further comprises:

a plurality of closed circuit hydraulic pumps including the closed circuit hydraulic pump;

a plurality of open circuit hydraulic pumps including the open circuit hydraulic pump;

a plurality of actuators including single rod hydraulic cylinders, including the single rod hydraulic cylinder, and another hydraulic actuator;

a plurality of first switching valves including the first switching valve; and a plurality of proportional control valves including the proportional control valve, wherein:

the closed circuit hydraulic pumps are connected to at least the single rod hydraulic cylinders included in the actuators via second switching valves, and at least part of the open circuit hydraulic pumps are connected to the head-side chambers of the single rod hydraulic cylinders via the first switching valves, and at least an other part of the open circuit hydraulic pumps is connected to the another hydraulic actuator via a third switching valve, and the proportional control valves are arranged respectively in hydraulic lines situated between the hydraulic fluid tank and the head-side chambers of the single rod hydraulic cylinders.

2. The hydraulic system for a work machine according to claim 1, wherein the control unit controls the delivery flow rate of the open circuit hydraulic pump so that at times of extension of the hydraulic cylinder a flow rate of the hydraulic fluid sent from the open circuit hydraulic pump to the head-side chamber of the hydraulic cylinder is determined based on a difference between a head-side chamber flow rate and a rod-side chamber flow rate which difference is caused by a pressure-receiving area difference between the head-side chamber and the rod-side chamber of the hydraulic cylinder.

3. The hydraulic system for a work machine according to claim 1, wherein the control unit at times of retraction of the hydraulic cylinder controls the proportional control valve so that a flow rate of the other part of the outward flow from the head-side chamber of the hydraulic cylinder returned to the hydraulic fluid tank is determined based on the difference between a head-side chamber flow rate and a rod-side chamber flow rate which difference is caused by a pressure-receiving area difference between the head-side chamber and the rod-side chamber of the hydraulic cylinder.

4. The hydraulic system for a work machine according to claim 1, wherein at times of retraction and regeneration operation of the hydraulic cylinder, when energy regenerated via the closed circuit hydraulic pump by returning the part of the outward flow from the head-side chamber of the hydraulic cylinder to the closed circuit hydraulic pump exceeds a permissible regeneration amount of the work machine, the control unit controls the proportional control valve so that a part of the part of the outward flow returned to the closed circuit hydraulic pump is returned to the hydraulic fluid tank.

5. The hydraulic system for a work machine according to claim 1, wherein:

the work machine is a hydraulic excavator equipped with a swing hydraulic motor and a boom cylinder, and the single rod hydraulic cylinder is the boom cylinder, and another open circuit hydraulic pump is provided separately from the open circuit hydraulic pump and the another open circuit hydraulic pump is connected to the swing hydraulic motor via a control valve.

* * * * *